US005553582A

United States Patent [19]

Speas

[11] Patent Number: 5,553,582

[45] Date of Patent: Sep. 10, 1996

[54] NUTATING DISC ENGINE

[76] Inventor: Danny E. Speas, P.O. Box 715, Haiku, Hi. 96708

[21] Appl. No.: 368,599

[22] Filed: Jan. 4, 1995

[51] Int. Cl.[6] ..... F02B 75/26

[52] U.S. Cl. ..... 123/56.4

[58] Field of Search ..... 123/56.3, 56.4, 123/56.6

[56] References Cited

U.S. PATENT DOCUMENTS

| | | | |
|---|---|---|---|
| 3,319,874 | 5/1967 | Welsh et al. | 123/56.4 |
| 4,066,049 | 1/1978 | Teodorescu et al. | 123/48 |
| 4,100,815 | 7/1978 | Kemper | 74/60 |
| 4,131,094 | 12/1978 | Crise | 123/48 |
| 4,258,590 | 3/1981 | Meijer et al. | 123/56.4 |
| 4,270,495 | 6/1981 | Freudenstein et al. | 123/54 |
| 4,433,596 | 2/1984 | Scalzo | 123/56.3 |
| 4,497,284 | 2/1985 | Schramm | 123/56.4 |
| 5,007,385 | 4/1991 | Kitaguchi | 123/78 E |
| 5,113,809 | 5/1992 | Ellenburg | 123/56.4 |
| 5,136,987 | 8/1992 | Schechter et al. | 123/48 |
| 5,165,368 | 11/1992 | Schecter | 123/48 |
| 5,368,449 | 11/1994 | Kimura et al. | 417/269 |
| 5,415,077 | 5/1995 | Ono | 92/71 |

FOREIGN PATENT DOCUMENTS

| | | | |
|---|---|---|---|
| 2461813 | 2/1981 | France | 123/56.3 |
| 2647508 | 11/1990 | France . | |
| 2753563 | 6/1979 | Germany . | |
| 3043251 | 7/1982 | Germany | 123/56.3 |
| 8901197 | 12/1990 | Netherlands . | |
| 286075 | 3/1928 | United Kingdom . | |
| 2219836A | 12/1989 | United Kingdom . | |

*Primary Examiner*—David A. Okonsky
*Attorney, Agent, or Firm*—Richard C. Litman

[57] ABSTRACT

The present invention is directed to a reciprocating piston, multi-cylinder internal combustion engine. The piston rods impinge on a nutating disc. The nutating disc is constrained in its movements in part by a constant-velocity (C.V.) joint. Movement of the C.V. joint along the longitudinal axis of the main engine shaft allows continuous variation of the engine compression ratio. Variation of the amount of wobble of the nutating disc allows the continuous variation of the engines displacement. In addition the engine can be provided with means for varying the valve lift and timing. The engine parameters may be varied in response to a variety of sensor inputs to ensure optimum engine performance under a wide variety of load conditions.

18 Claims, 21 Drawing Sheets

NUTATING DISC ENGINE

BACKGROUND OF THE INVENTION

1. Field of the Invention

The present invention relates to an internal combustion engine having a nutating member. The engine also has provision for continuously varying engine parameters such as displacement, compression ratio, valve timing, and valve lift.

2. Description of the Prior Art

It has been known in the art that the traditional fixed-geometry internal combustion engines cannot perform optimally over their entire operational rpm and torque range. For this reason, many designs have been proposed in the prior art that allow the variation of one or several of the more important engine parameters such as compression ratio, displacement, and valve timing.

U.S. Pat. No. 5,165,368, issued to Schechter, shows a variable compression ratio engine where the compression ratio is varied by varying the crank radius using a mechanical and hydraulic mechanism responsive to the torsional impulses applied through the connecting rod. The Schechter system cannot vary the compression ratio independent of the piston stroke.

U.S. Pat. No. 5,136,987, issued to Schechter et al., shows a variable piston stroke engine where the piston stroke is varied by varying the length of an arm extending between the connecting rod pivot, distal from the piston, and the engine block. Again the Schechter et al. system does not permit the independent variation of the compression ratio and the piston stroke.

U.S. Pat. No. 4,270,495, issued to Freudenstein et al., shows a variable stroke engine where the stroke is varied by changing the pivot point of a rocker arm extending between the connecting rods of two adjacent cylinders.

U.S. Pat. No. 4,131,094, issued to Crise, shows a variable stroke engine where the stroke is varied by varying the crank radius. Again the Crise system does not permit the independent variation of the compression ratio and the piston stroke.

U.S. Pat. No. 4,100,815, issued to Kemper, shows a variable displacement engine where the displacement is varied by the rotation of an eccentric sleeve relative to a nutating member. The Kemper engine suffers from the serious drawback that the nutating member is constrained from rotation about the output shaft only by the forces exerted on the pistons by the cylinder walls. Thus the reaction torque on the nutating member is borne entirely by the piston sides and cylinder walls. For this reason the Kemper engine would suffer from rapid wear damage to the cylinder walls and piston sides resulting in their premature failure. Further, in the Kemper engine the forces of the pistons act at a distance from the axis of the output shaft, which is greater than the distance, from the axis of the output shaft, of the forces between the nutating member and the rotating support member. The greater moment arm of the piston forces greatly amplifies the forces on the bearing surfaces of the nutating member and the rotating support member, thus leading to faster wear and consequent mechanical failure.

U.S. Pat. No. 4,066,049, issued to Teodorescu et al., shows a variable displacement engine where the displacement is varied by moving the bracket supporting the nutating member relative to the cylinder block. The Teodorescu et al. engine suffers from the same drawbacks enumerated with respect to the Kemper engine. In addition, there are no discernable means in the Teodorescu et al. engine for counteracting the torque on the output shaft of the engine. Although Teodorescu et al. do not explicitly state how the connecting rods attach to the pistons, the geometric constraints imposed by nutation of the equatorial band of the Teodorescu et al. engine would dictate that the piston rods should be ball-jointed at both ends. Therefore, the only rotational constraint on the equatorial band of the Teodorescu et al. engine would be the piston rods crashing into the bottoms of the cylinder bores. It should be readily apparent that such an arrangement would lead to rapid wear and consequent premature mechanical failure of the piston rods and the cylinder bore bottoms.

French Patent Document Number 2 647 508, by Jurkovic, shows a variable compression ratio engine where the compression ratio is varied by moving the axis of rotation of the crank shaft relative to the cylinder block.

German Patent Document Number 27 53 563, by Zeilinger, shows a variable compression ratio engine where the compression ratio is varied by varying the connecting rod length.

Netherlands Patent Document Number 8901197, by Van Hoeven, shows a variable compression ratio engine where the compression ratio is varied by moving the pivot point of a rocker arm extending between the piston rod and a connecting rod engaging the throw of the crankshaft.

United Kingdom Patent Document Number 2 219 836 A, by Heniges, shows a variable stroke engine where the stroke is varied by changing the crank radius using an eccentric mounted on the crank throw.

United Kingdom Patent Document Number 286,075, by Myers, shows a variable stroke engine where the stroke is varied by a pivoting plate extending between the piston rod and a rod connected to the crankshaft throw. The Myers design does not allow for dynamic control of the piston stroke and compression ratio in response to engine load conditions.

None of the above inventions and patents, taken either singly or in combination, is seen to describe the instant invention as claimed.

SUMMARY OF THE INVENTION

The present invention is directed to an internal combustion engine having a nutating disc. The nutating disc is constrained in its movements in part by a constant-velocity (C.V.) joint. Movement of the C.V. joint along the longitudinal axis of the main engine shaft allows continuous variation of the engine compression ratio. Variation of the amount of wobble of the nutating disc allows the continuous variation of the engine's displacement. In addition the engine can be provided with means for varying the valve lift and timing. The engine parameters may be varied in response to a variety of sensor inputs to ensure optimum engine performance under a wide variety of load conditions. Further, the engine parameters may be varied in order to match engine power output to the particular work load without the need for a gearbox.

Accordingly, it is a principal object of the invention to provide an engine wherein critical engine parameters such as piston stroke, compression ratio, valve lift, and valve timing can be dynamically varied to optimize the values of those parameters for a particular application.

It is another object of the invention to provide an engine having a nutating member which is rotationally constrained by means other than its pistons and cylinder walls or its connecting rods.

It is a further object of the invention to provide an engine wherein critical engine parameters such as piston stroke, compression ratio, valve lift, and valve timing are independently variable.

Still another object of the invention is to provide an engine wherein the engine output can be matched to the work load without the need for a gearbox.

Still another object of the invention is to provide an engine wherein the engine output can be matched to the work load using fewer gear ratios than would be required with a conventional engine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIGS. 6A, 6B show side and top views of the compression ratio control hub of the nutating disc engine in isolation.

FIG. 9I shows a cross sectional view of a cylinder head.

Similar reference characters denote corresponding features consistently throughout the attached drawings.

DETAILED DESCRIPTION OF THE PREFERRED EMBODIMENT

Figure 1:
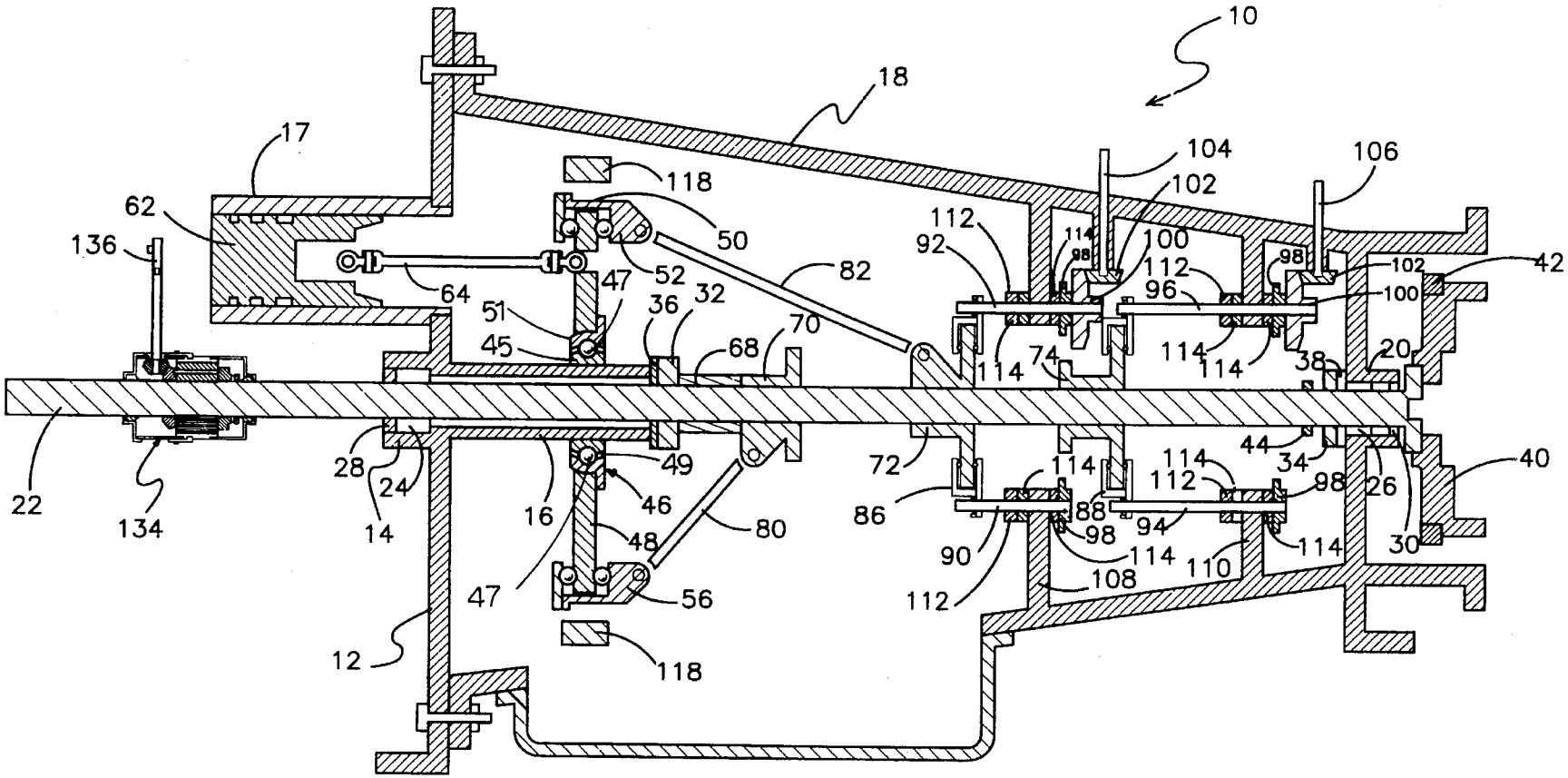
FIG. 1 is a cross sectional view of the nutating disc engine of the present invention with the nutating disc at a zero angle of nutation.

Referring to FIGS. 1 to 10B the present invention is a dynamically variable nutating-disc engine 10. The engine 10 is assembled around a support plate 12 which is provided with a bearing housing 14 and a splined rigid tube 16. Support plate 12 has three equally spaced holes for receiving cylinders 17 which are axially parallel to each other and perpendicular to the plane of plate 12.

Figure 2:
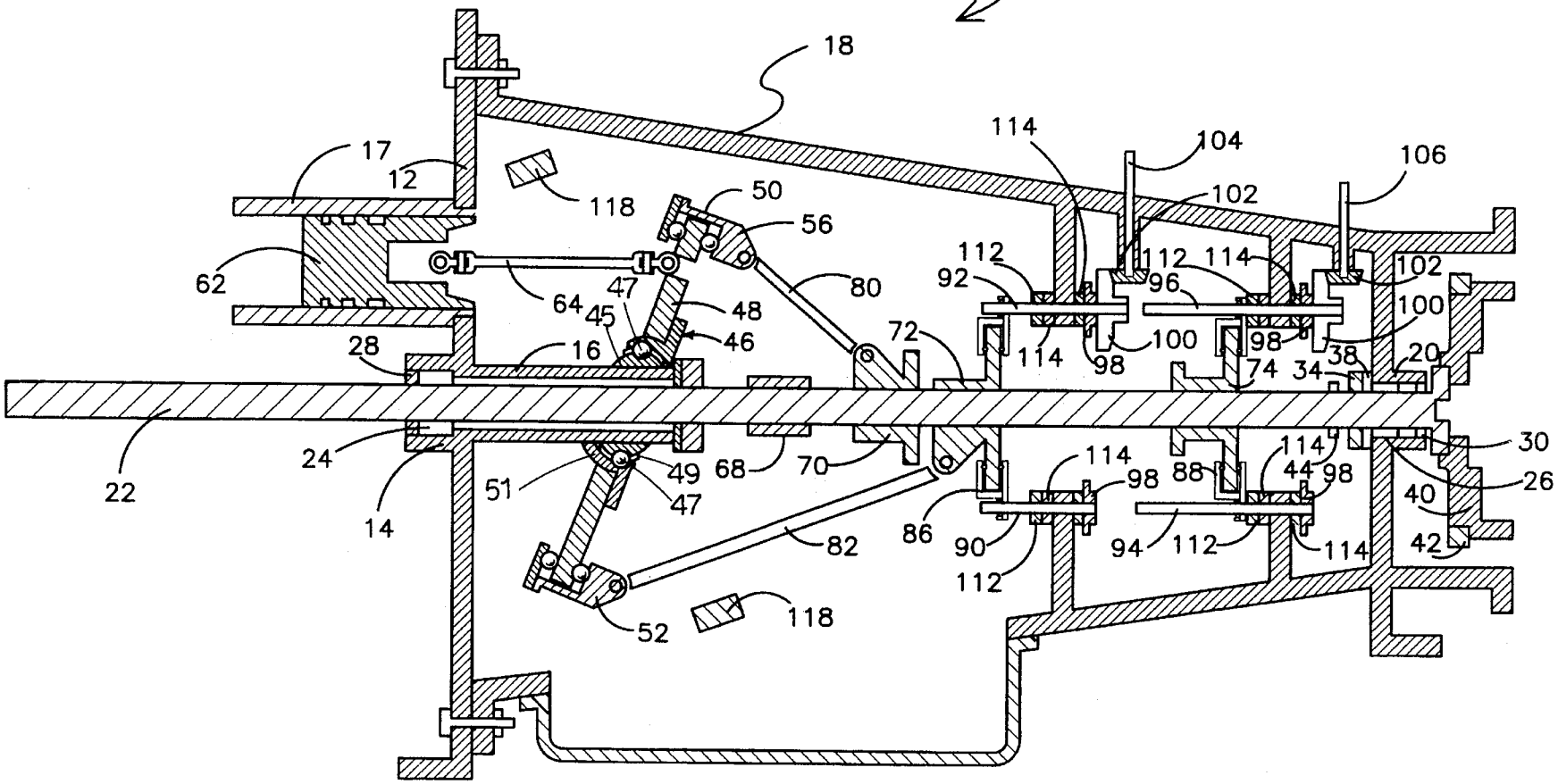
FIG. 2 is a cross sectional view of the nutating disc engine of the present invention with the nutating disc at a non-zero angle of nutation.
Figure 3B:
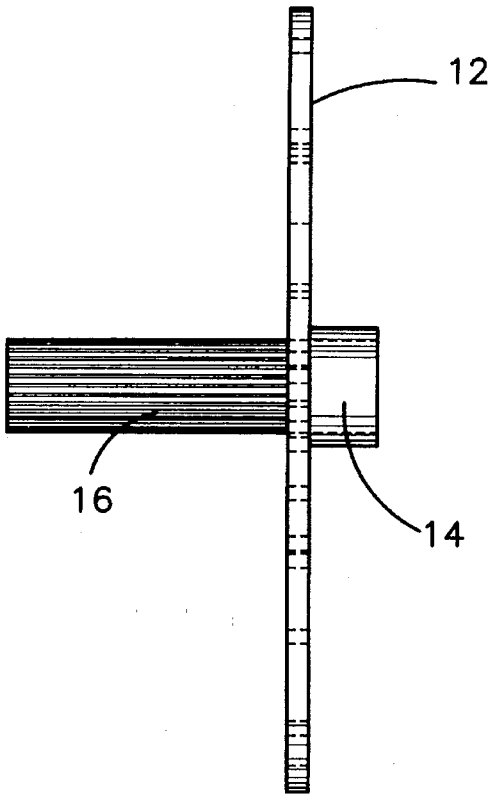
FIGS. 3A, 3B show front and side views of the support plate of the nutating disc engine in isolation.
Figure 3A:
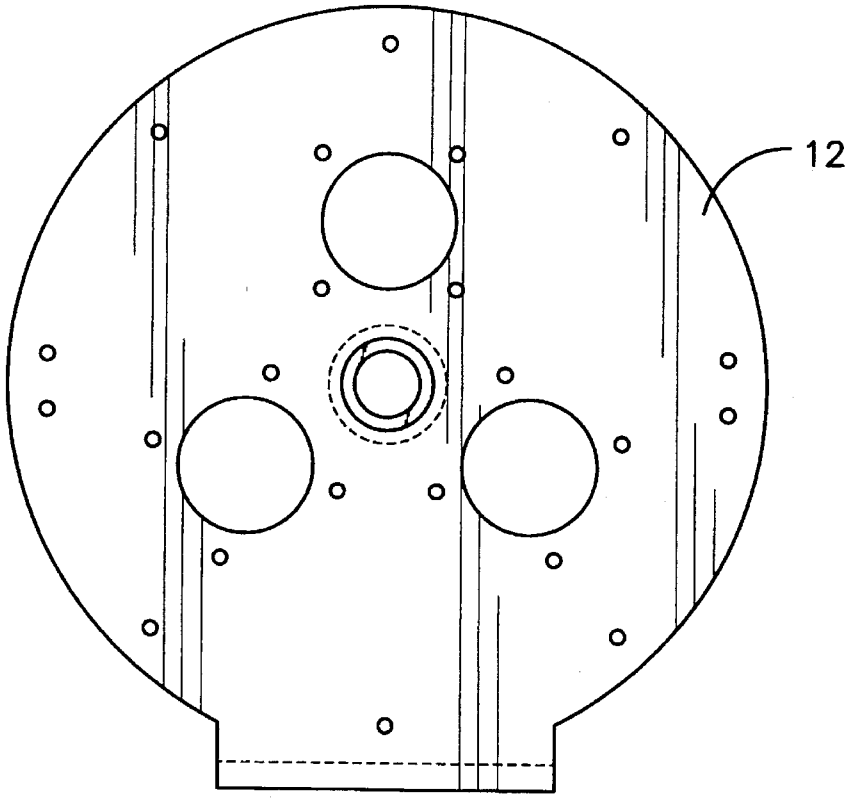

Bolted to plate 12 is a rigid housing 18 which also has a bearing housing 20 (see FIG. 1). A main engine shaft 22 extends through both bearing housings 14 and 20, as shown in FIGS. 1 and 2, and is directly supported by bearings 24 and 26. Lubricant leakage around main shaft 22 is prevented by oil seals 28 and 30. Main shaft 22 is axially stabilized by collars 32 and 34 which act upon thrust bearings 36 and 38. A flywheel 40 is mounted onto one end of main shaft 22 and it is fitted with a starter gear 42. Also mounted on main shaft 22 is a gear 44 which drives an oil pump (not shown).

Onto tube 16 is mounted a constant velocity type ball joint (C.V. joint) 46. This is a well-established piece of automotive hardware that has heretofore been used primarily to supply power to the front wheels of vehicles. C.V. joint 46 is centrally drilled and splined to match the splines of tube 16. It also has an asymmetrically positioned flange to which a nutating disc 48 is bolted into a position so that its central plane always passes through the center of C.V. joint 46. The C.V. joint 46 has an inner ball portion 45, ball bearings 47, cage 49, and outer socket portion 51. The ball portion 45 is internally and externally splined, while the socket portion 51 is internally splined. Ball bearings 47 engage respective grooves, grooves being the areas between the splines, in the ball portion 45 and the socket portion 51 to thereby prevent any relative rotation between the ball portion and the socket portion. Cage 49 is located intermediate the ball portion 45 and the socket portion 51, and acts to retain the ball bearings within the C.V. joint 46.

C.V. joint 46 is capable of moving axially along tube 16 but it cannot rotate about the tube 16 because of its splined relationship to tube 16. Consequently disc 48 can freely wobble, i.e. nutate, in any direction and it can move axially along tube 16 but it cannot rotate in its own plane. The amount of the nutation of disc 48 is quantified by the angle of nutation of the disc 48. This angle of nutation is defined by the angle between a line normal to the plane of the disc 48 and the longitudinal axis of the main shaft 22.

Onto the outer rim of disc 48 is mounted a slew ring 50 which can spin relative to disc 48. Preferably ball bearings are provided between disc 48 and slew ring 50 to minimize friction. Slew ring 50 is concentric with disc 48 and it has four attachment structures 52, 54, 56, and 58 (see FIGS. 5C, 5D) which are consecutively spaced 90 degrees apart and which collectively control the orientation and position, along tube 16, of slew ring 50. Consequently, these four attachment structures also control all positional aspects of disc 48 except its rotational movement, about tube 16, which is prevented by C.V. joint 46 and the splines on tube 16. Also provided on slew ring 50 are two additional attachment structures 60 which are equidistant from attachment structures 54 and 58.

Figure 5A:
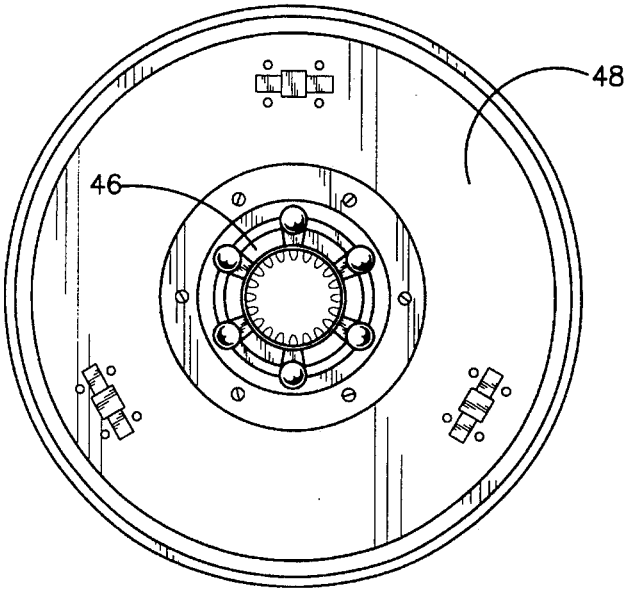
FIGS. 5A, 5B show front and side views of the nutating disc and constant velocity joint assembly in isolation.
Figure 5B:
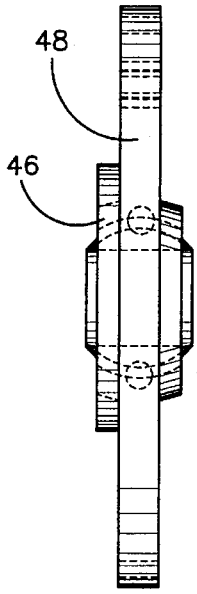
Figure 5C:
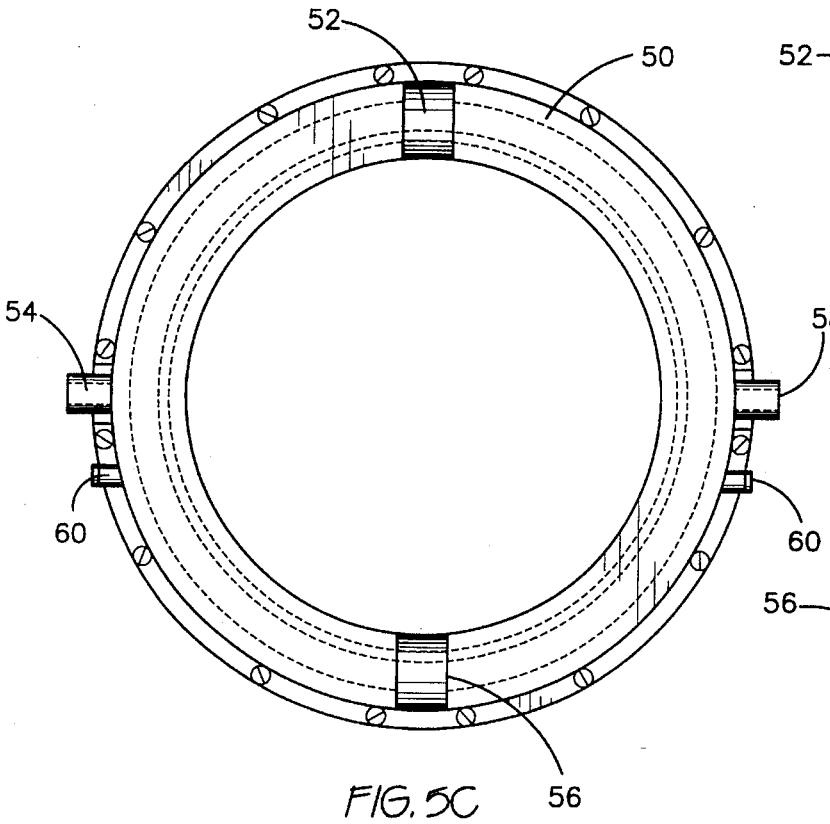
FIGS. 5C, 5D show front and side views of the slew ring in isolation.
Figure 5D:
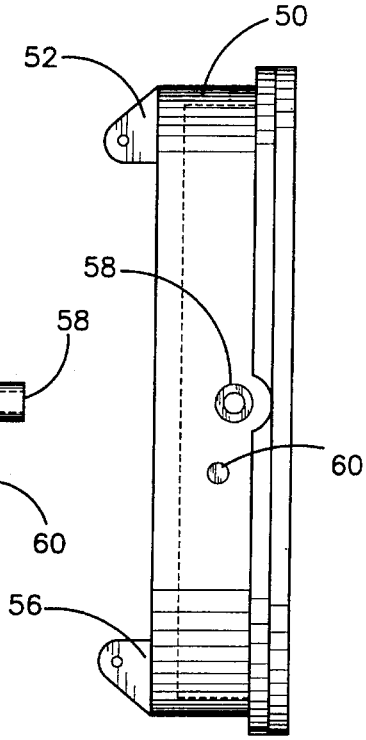
Figure 5E:
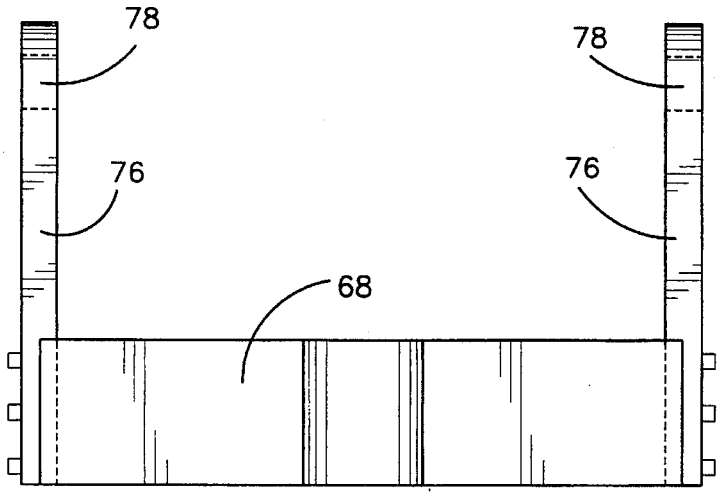
FIGS. 5E, 5F and 5G show side, end, and top views of the stabilizing hub of the nutating disc engine in isolation.
Figure 5F:
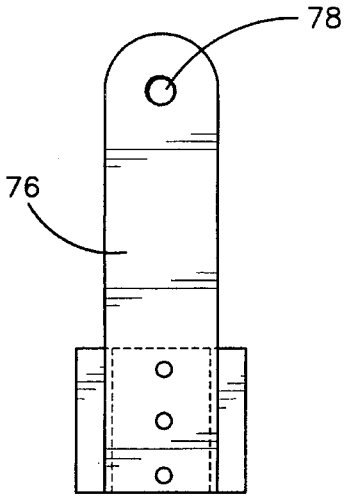
Figure 5G:
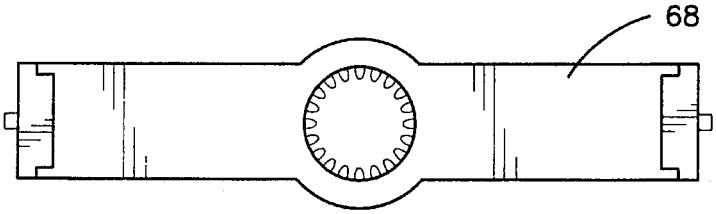
Figure 5H:
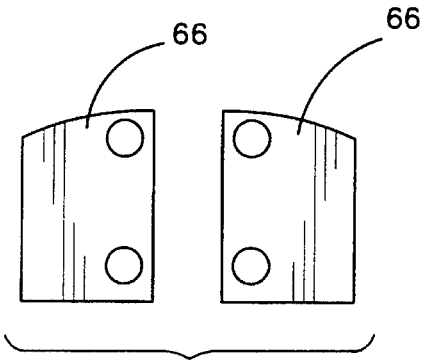
FIG. 5H shows top views of the bearing caps of the nutating disc engine in isolation.
Figure 5I:
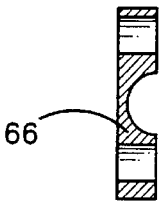
FIG. 5I shows a cross sectional view of the bearing cap of the nutating disc engine in isolation.
Figure 5J:
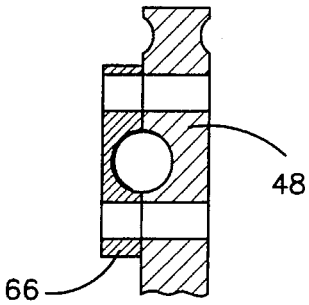
FIG. 5J shows a cross sectional view of the bearing cap fitted to the nutating disc.

FIGS. 1 and 2 show connected to disc 48 on one end and to a piston 62 on the other, a piston rod 64 which is equipped with two wrist pins that are perpendicular to each other (as viewed along the axis of rod 64) on each of its ends. Rod 64 is attached to disc 48 by bearing caps 66 as shown in FIGS. 5H, 5I, and 5J.

As a result of the above described configuration, FIGS. 1 and 2 show that the axial position of piston 62 along cylinder 17 is completely controlled by the axial position of C.V. joint 46 on tube 16, the angle of nutation of disc 48, and the nutational phase of disc 48 relative to cylinder 17.

Figure 4:
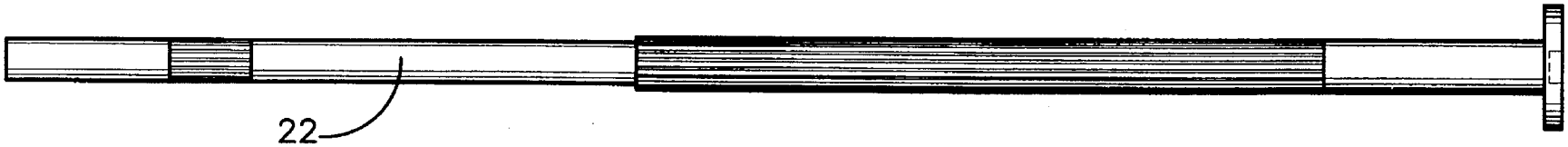
FIG. 4 shows an elevational view of the main engine shaft in isolation.

Main shaft 22 is splined from the point where it emerges from collar 32 for approximately 87% of the distance to gear 44 and it has a reduced diameter from that same point for the remainder of its length in the opposite direction (see FIG. 4).

Onto the splined section of main shaft 22 are fitted four slidable control hubs equipped with splines that match those of main shaft 22. These hubs as shown in FIGS. 1 and 2 are in order of their positions from plate 12, a stabilizer hub 68, a secondary stroke-control hub 70, a compression-ratio control hub 72, and a primary stroke control hub 74.

Hub 68 is equipped with two arms 76 which extend out in a tuning-fork-like arrangement and which have bearing holes 78 which engage attachment structures 54 and 58 of slew ring 50 (see FIGS. 5C, 5D and 5E, 5F 5G. This arrangement fixes the slew ring 50 to the main shaft 22, in the sense that the slew ring 50 and the main shaft 22 must rotate together as a unit about the longitudinal axis of the main shaft 22. Further, this arrangement limits movement of slew ring 50 relative to hub 68, to rotation about the axial line between holes 78. This axial line between holes 78 passes through the center of C.V. joint 46.

Hub 70 is attached to attachment structure 56 by a control rod 80, and hub 72 is connected to attachment structure 52 by a similar but longer control rod 82 so that the axial positions of hubs 70 and 72 control the axial position of C.V. joint 46 on tube 16 and the angle of nutation of disc 48.

Figure 6A:
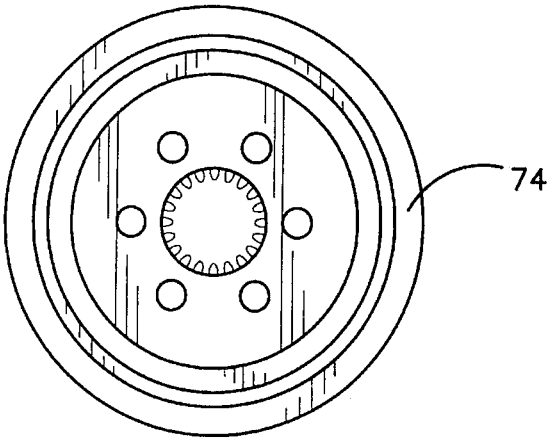
FIG. 6A, 6B show top and side views of the piston stroke control hub in isolation.
Figure 6B:
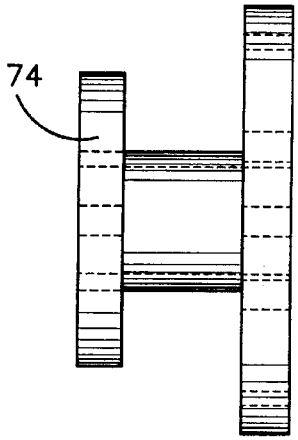
Figure 6C:
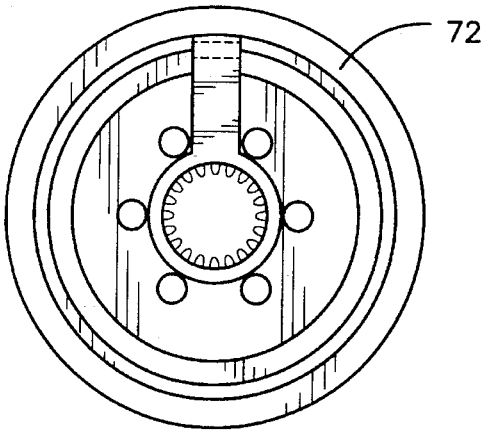
FIGS. 6E, 6F show top and side views of the secondary piston stroke control hub of the nutating disc engine in isolation.
FIG. 6G shows a partial view showing the mechanism for synchronized turning of the control bolts.
FIG. 6H shows a rod used to connect the piston stroke control hub to the secondary piston stroke control hub, in isolation.
FIG. 6I is a side elevational view showing the positional relationship of the various control hubs when assembled.
Figure 6D:
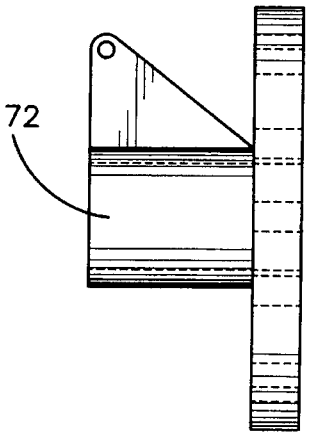
Figure 6E:
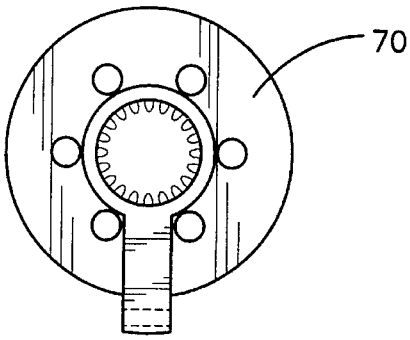
Figure 6F:
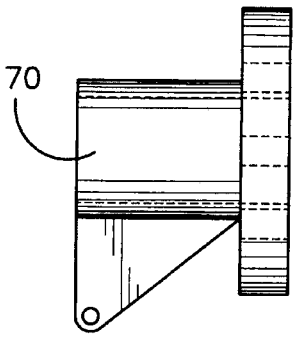
Figure 6G:
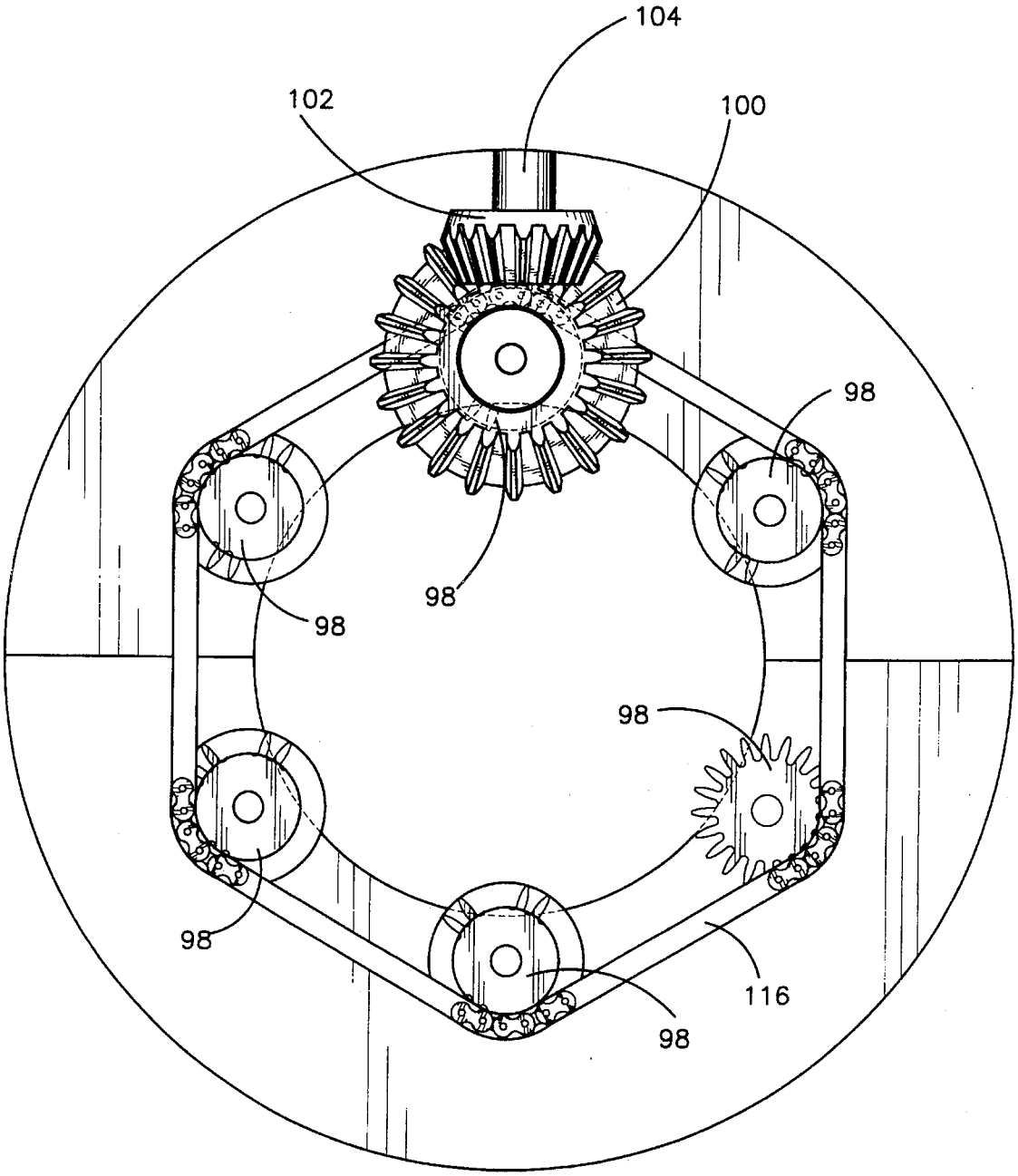
Figure 6H:
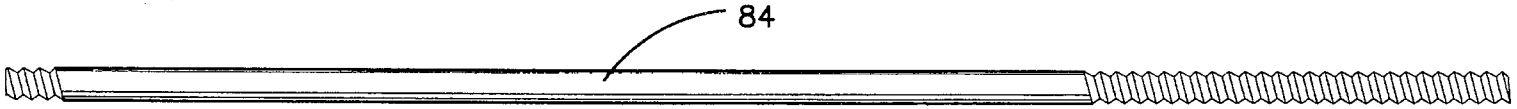
Figure 6I:
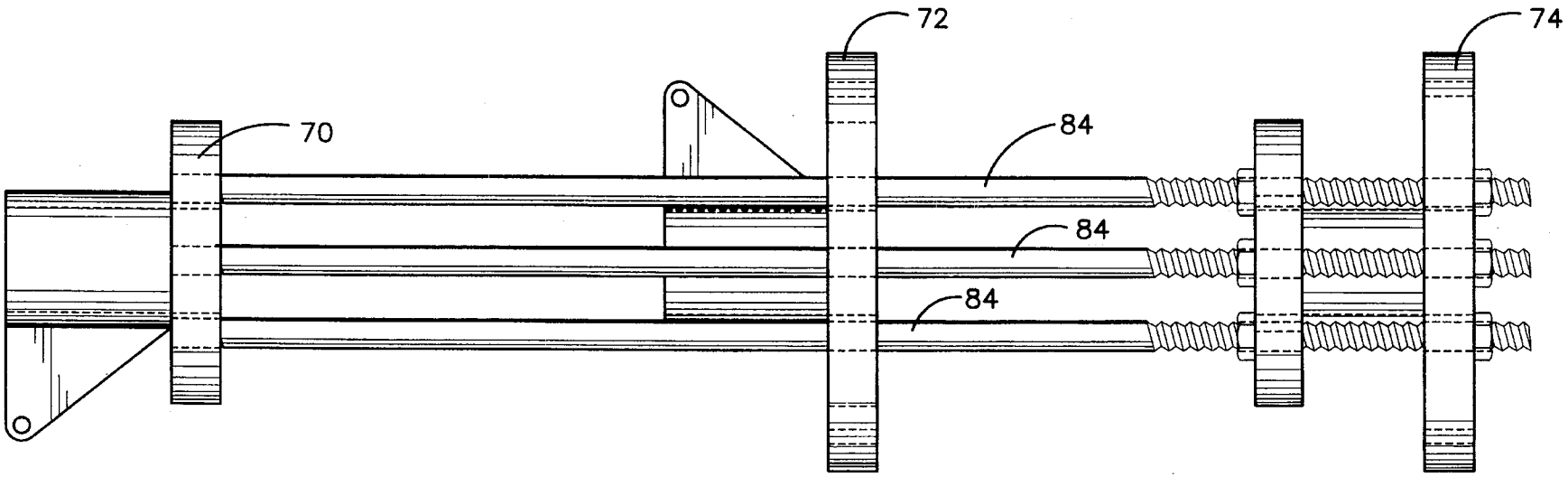

Hub 70 and hub 74 are rigidly connected to each other by a hexagonal array of partially threaded rods 84 which pass through respective openings in the flange at the base of hub 72 without interfering with the ability of hub 72 to slide along the main shaft 22 (see FIG. 6I). This arrangement is necessary as direct control of hub 70 is not possible because of rod 82 as shown in FIGS. 1 and 2.

Hubs 72 and 74 are fitted on their rims with bearing-mounted control slew rings 86 and 88 which are small versions of slew ring 50 except they have six equally spaced threaded holes in their outer rims instead of the attachment structures of slew ring 50. These threaded holes are matched to position control bolts 90 and 92, which control the axial position of control slew ring 86, and to position control bolts 94 and 96, which control the axial position of control slew ring 88.

There are five bolts 90 which all have chain sprockets 98 mounted onto one end (FIG. 6G) and there is one bolt 92 which is longer and has not only a sprocket 98 but also a bevel gear 100 mounted in such a way as to mesh with a smaller control bevel gear 102 which is fitted to a compression-ratio control rod 104.

Bolts 94 and 96 are similarly configured though they are longer than are bolts 90 and 92 because the stroke control hubs 70 and 74 must travel further than the compression ratio control hub 72. The stroke-control train terminates in a stroke-control rod 106. Both sets of control bolts pass through holes in rigid flanges 108 and 110 which project inwardly from housing 18 and which afford a solid base for the control action.

All control bolts 90, 92, 94, and 96 are equipped with positioning collars 112 which act on thrust bearings 114 to hold the bolts against axial forces. A chain 116 is provided for each set of sprockets 98. The chain 116 connects all six sprockets 98 of the respective set so that synchronization of the individual bolts within each set is ensured.

Figure 7A:
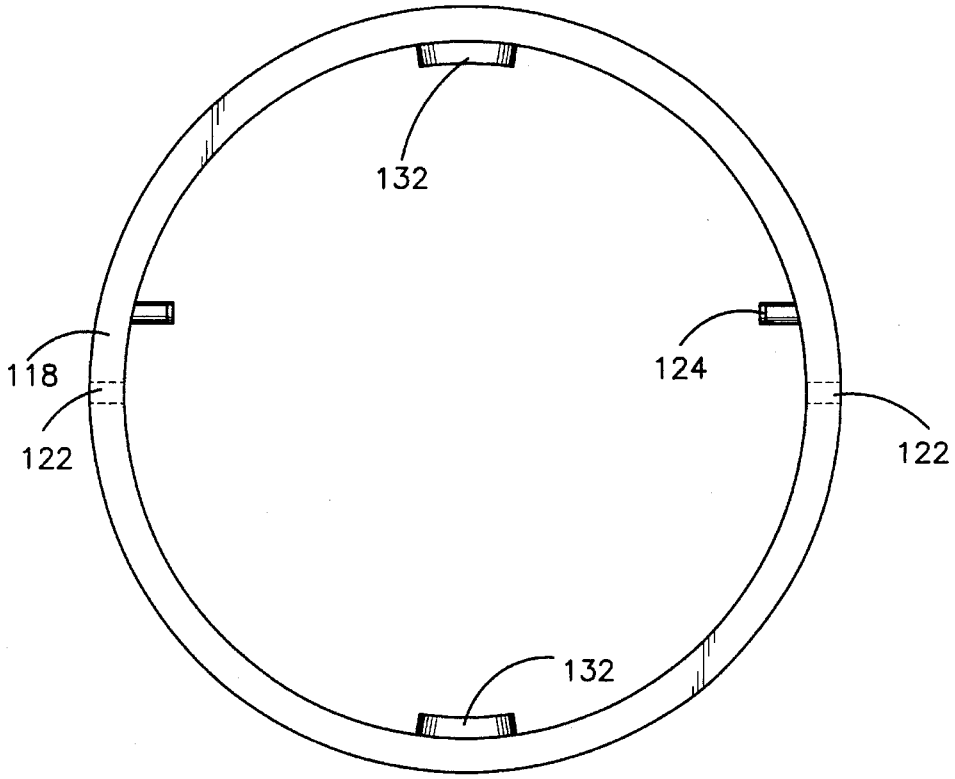
FIG. 7A is a top view of the balancer ring.
Figure 7B:
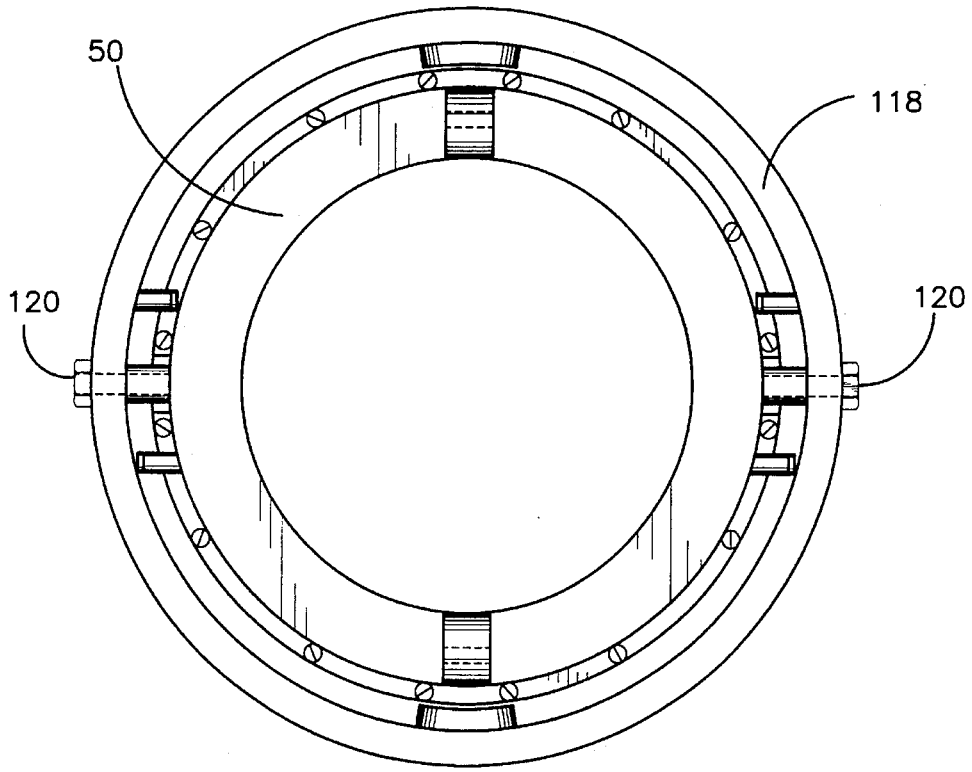
FIG. 7B is a top view of the balancer ring-slew ring assembly.
Figure 7C:
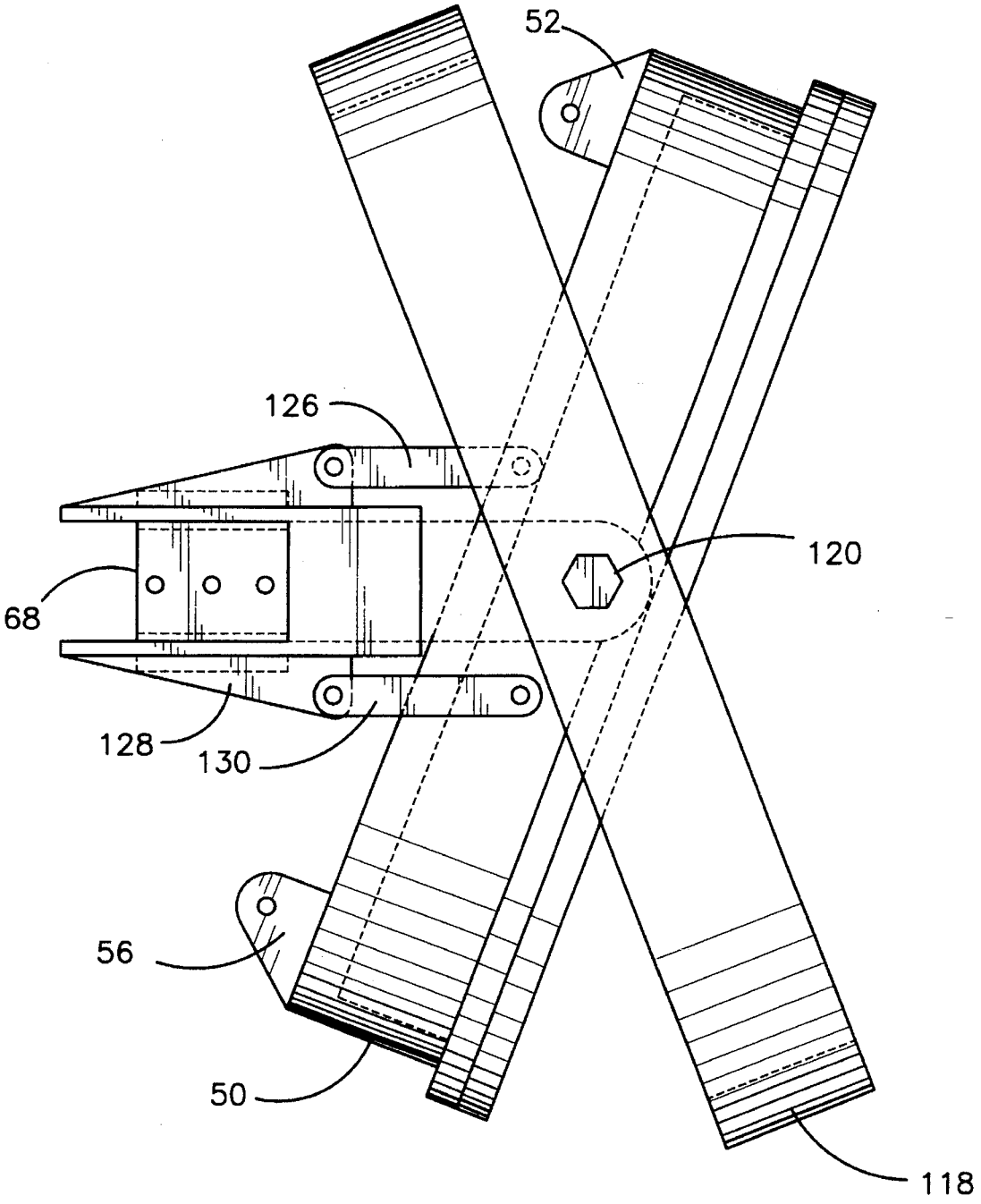
FIG. 7C is a side view of the balancer ring-slew ring assembly.
Figure 7F:
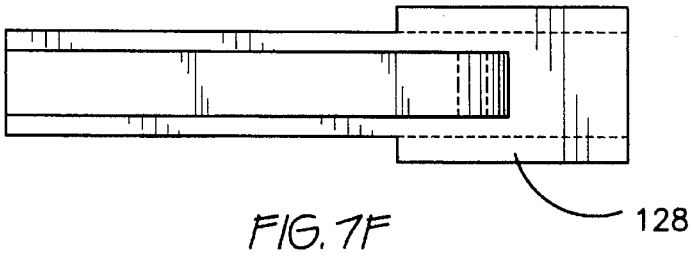
FIGS. 7D, 7E, 7F show side, front, and bottom views of the balancer slide.
Figure 7D:
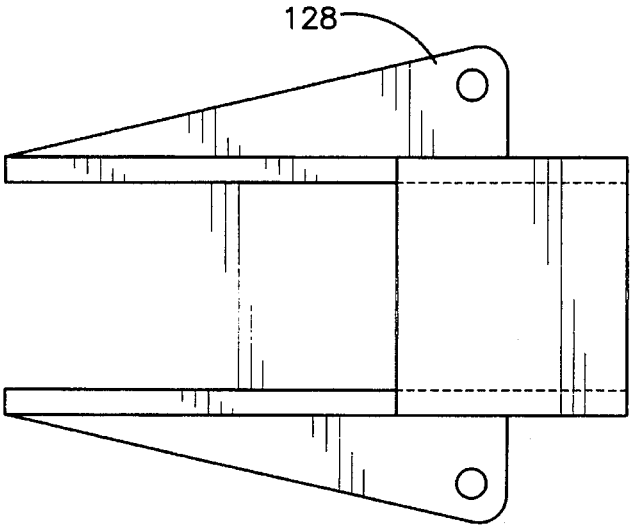
Figure 7E:
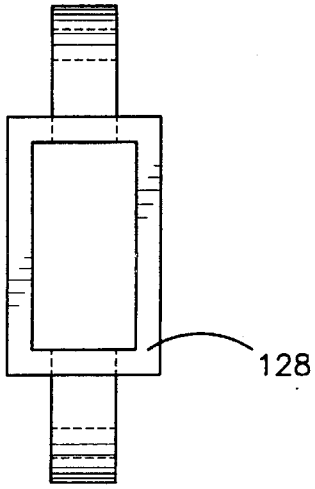
Figure 7G:
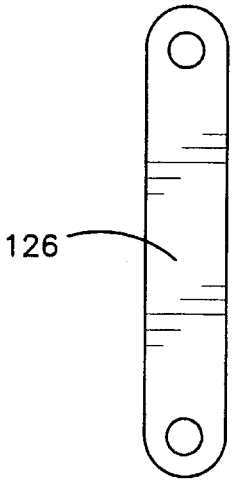
FIGS. 7G, 7H show side and front views of the balancer connecting rod.
Figure 7H:
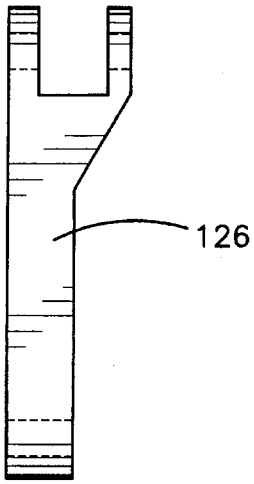
Figure 8A:
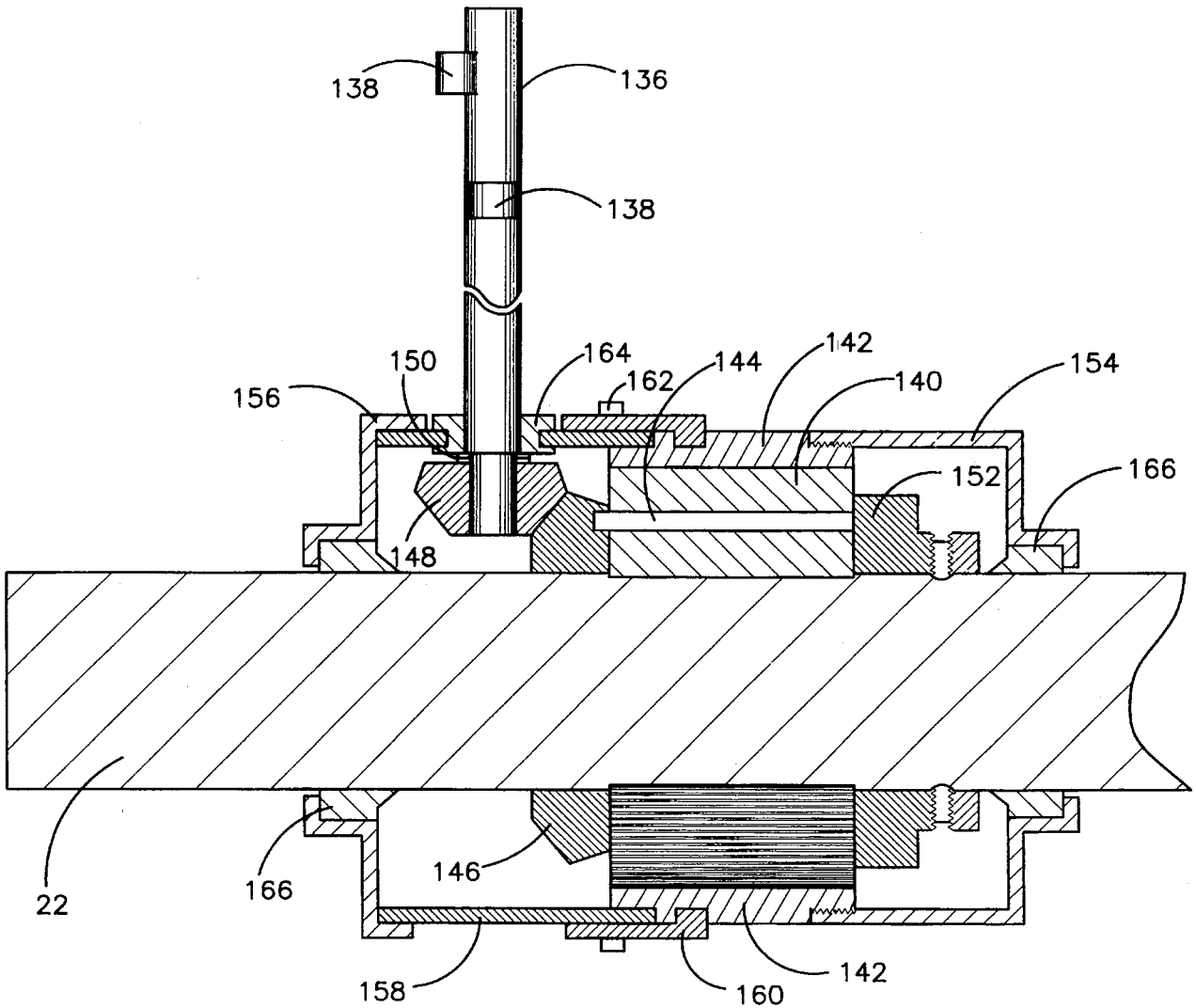
FIG. 8A shows a cross sectional view of the reduction gear pod used to drive the valve train.
Figure 8D:
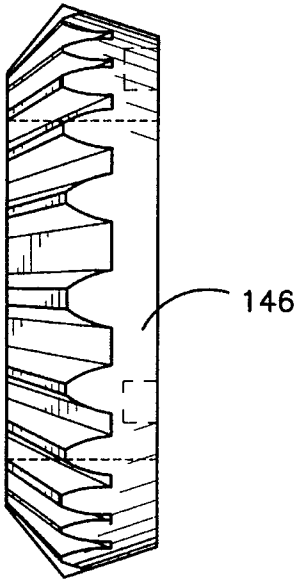
FIGS. 8C, 8D show side and top views of the bevel gear used to drive all cam shafts.
Figure 8C:
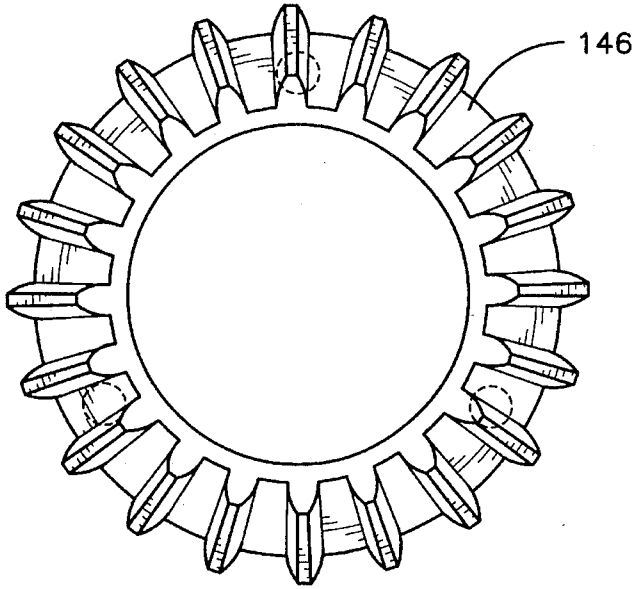
Figure 8B:
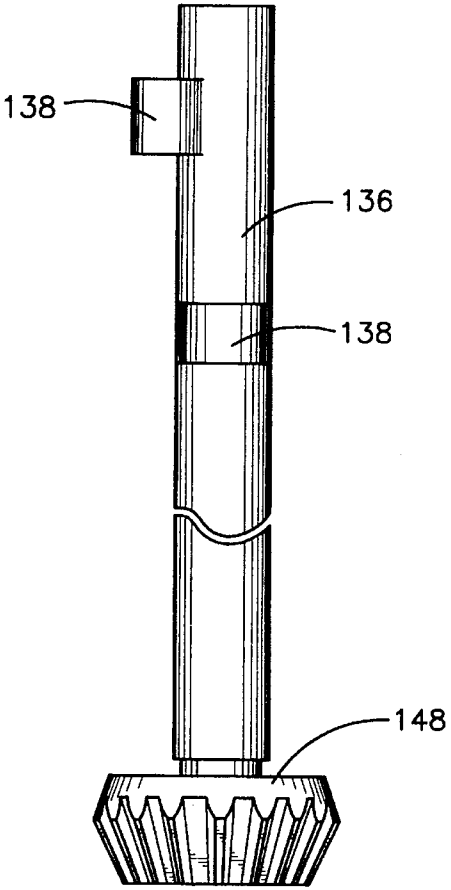
FIG. 8B shows a side elevational view of a cam shaft bevel gear assembly.
Figure 8F:
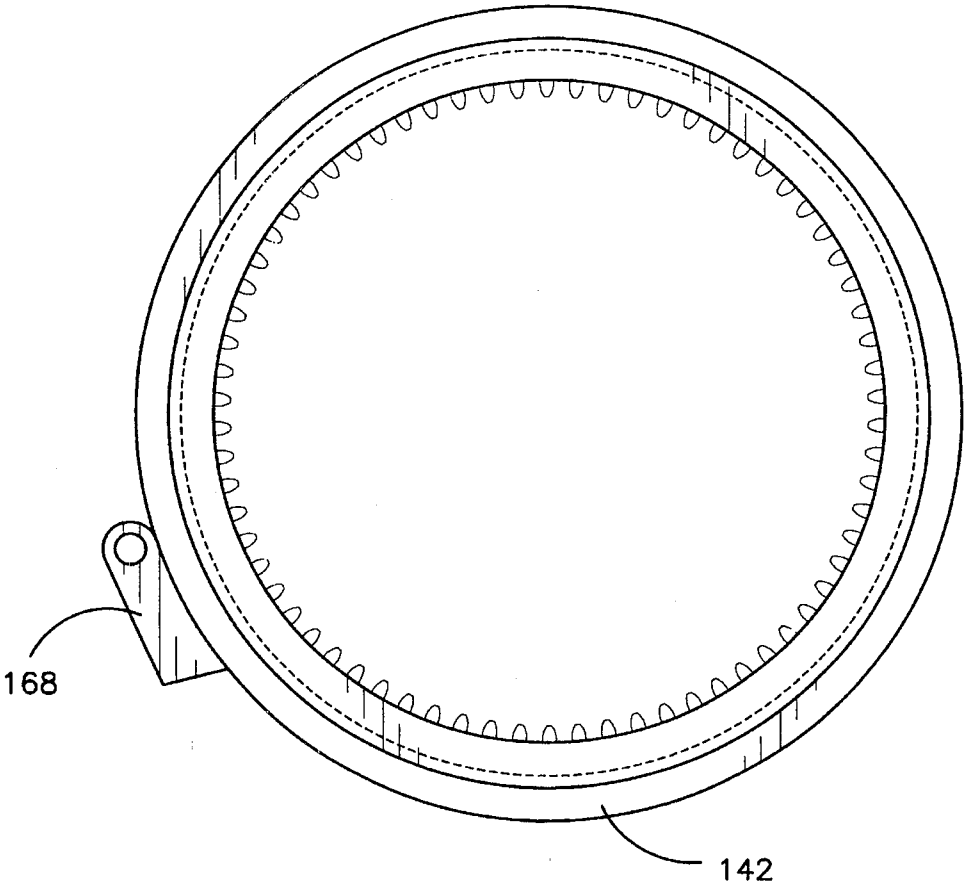
FIGS. 8E, 8F show side and front views of the sleeve of the reduction gear pod.
Figure 8E:
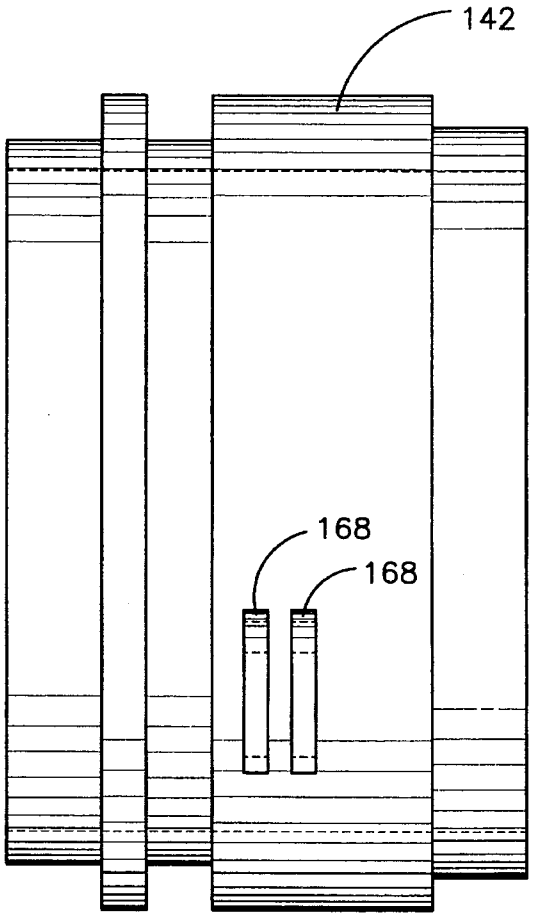
Figure 8H:
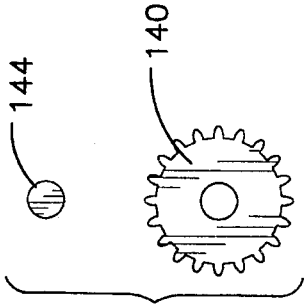
FIGS. 8G, 8H show side and front views of the planetary gear and its central pin in isolation.
Figure 8G:
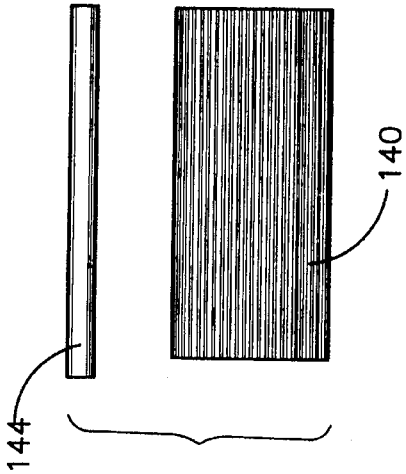
Figure 8I:
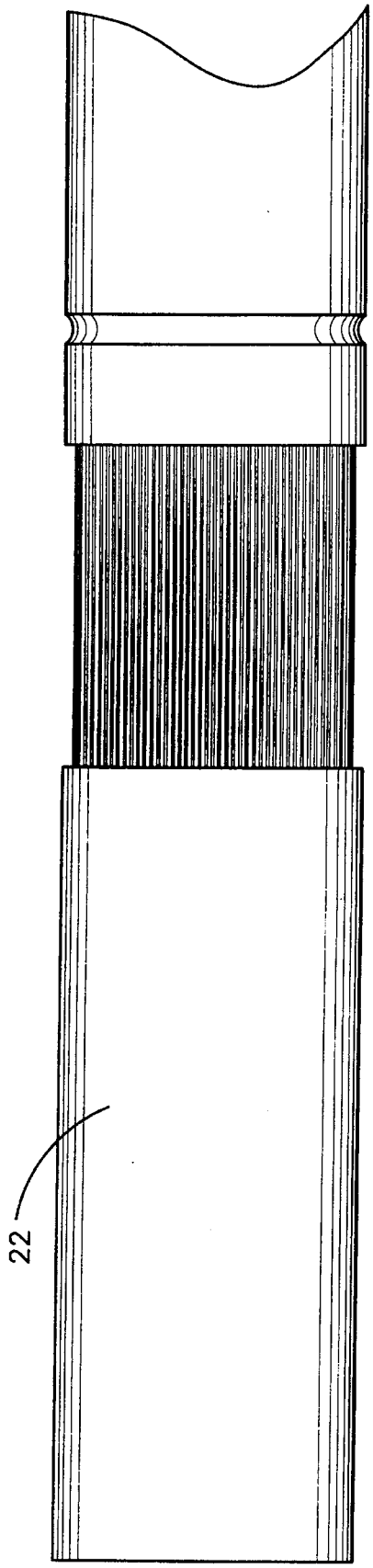
FIG. 8I shows a fragmentary view of the main shaft showing the toothed portion of the main shaft in detail.

A balancer ring 118 is mounted onto attachment structures 54 and 58 of slew ring 50 (FIG. 7B). Balancer 118 is held by two bolts 120 which pass through holes 122 into attachment structures 54 and 58, and it is able to rotate about the axial line between attachment structures 54 and 58. Balancer 118 has two couplings 124 located equidistantly from holes 122 which engage one end of respective connecting rods 126 (FIG. 7C, only one shown). The other ends of rods 126 are attached to respective balancer slides 128 by suitable pins (not shown separately).

Rods 130 extend between attachment structures 60, of slew ring 50, and respective balancer slides 128. Rods 130 are identical in structure to rods 126. Therefore the rods 130 are not shown in isolation. Optional if needed are balancer weights 132 (FIG. 7A) which attach to the inner surface of balancer 118 by machine screws (not shown).

Main shaft 22 continues through seal 28 as shown in FIG. 1 into the space between cylinders 17 to a point where it is even with the ends of cylinders 17. At this point begins a toothed section around which is mounted a gear-reduction pod 134 (see FIGS. 8A–8I) which drives valve cam shafts 136 on which are machined cam lobes 138.

Pod 134 uses three cylindrical planetary gears 140 to mesh with the toothed section of main shaft 22 and teeth milled into the inner surface of a cylindrical sleeve 142. The number of teeth cut into sleeve 142, also referred to herein as a ring gear, is twice the number on main shaft 22 and four times the number on gears 140.

Gears 140 are centrally drilled and fitted with pins 144 which protrude into three equally spaced holes in a bevel gear 146 which is mounted around main shaft 22. Gear 146 is in mesh with three equally spaced bevel gears 148 which have one half the number of teeth as does gear 146.

Gears 148 are centrally drilled and equipped with fine splines which match a splined, reduced-diameter end on each cam 136. The number of fine splines common to cams 136 and gears 148 is not evenly divisible by the number of teeth cut into gears 148, so that a maximum number of angular positions are possible for each cam 136 for any given angular setting of gear 146. Cams 136 are fitted with changeable shims 150 between the shoulders formed at the diameter-reduction point and the outer surfaces of gears 148. Shims 150 regulate the tightness of mesh between gears 146 and 148.

A stabilizing collar 152 is fitted onto main shaft 22 on the opposite side of gears 140 from gear 146. Collar 152 holds gears 140 and pins 144 in place.

Pod 134 is sealed by end cap 154 which screws onto sleeve 142 on the end nearest plate 12, and by end cap 156 which screws onto a cylindrical section 158 on the opposite side. The end cap 156 is secured to cylindrical section 158 using left-handed threading. Cylindrical section 158 has three equally spaced holes which admit cams 136 into pod 134. It is sealed to sleeve 142 by a lipped rubber tube 160 which is held in place by a tensile band 162. Cams 136 are sealed to section 158 by rubber Grommets 164. Caps 156 and 154 are sealed around main shaft 22 by rubber seals 166.

Figure 9A:
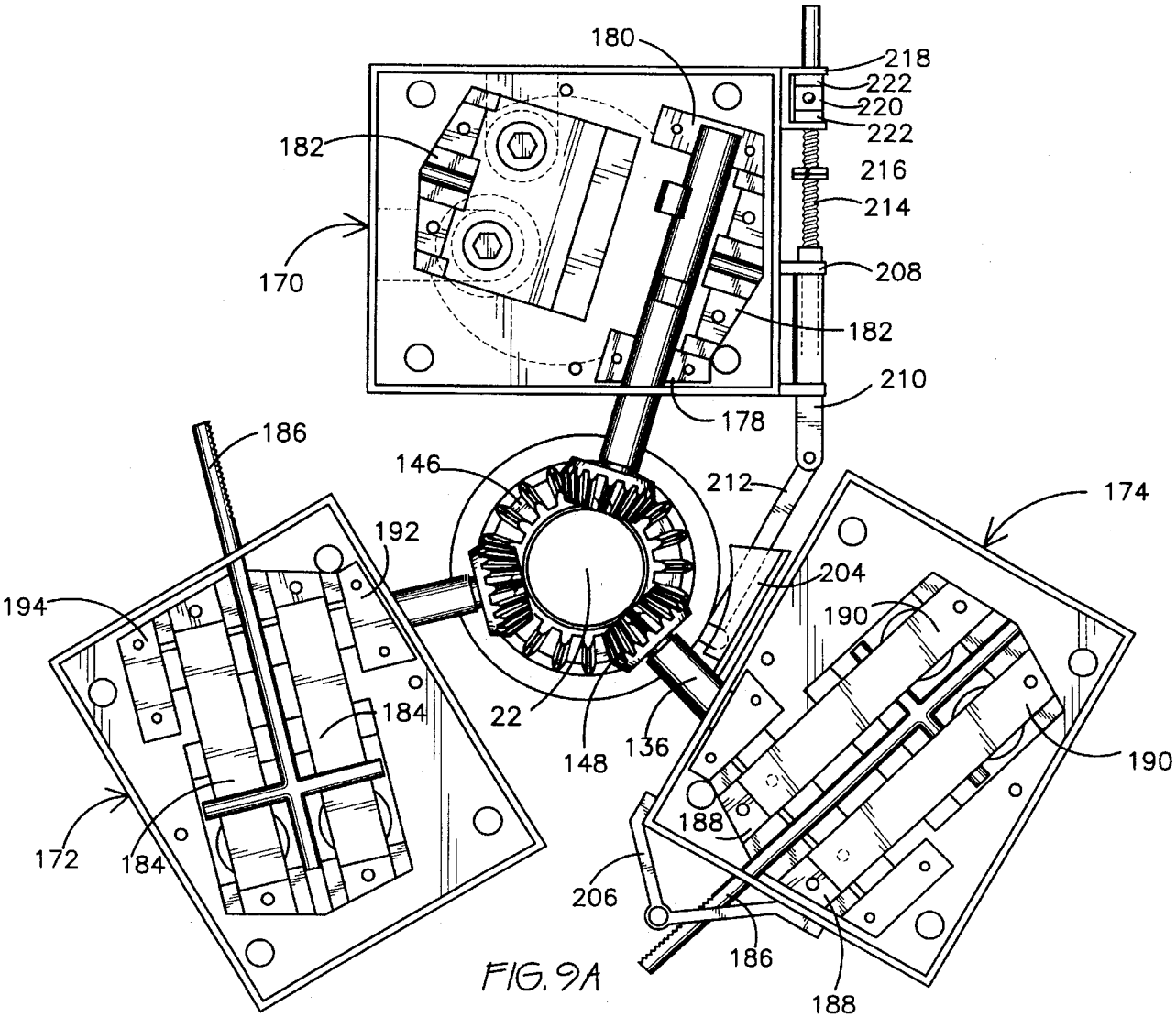
FIG. 9A shows a fragmentary top view of the partially assembled cylinder heads.
Figure 9E:
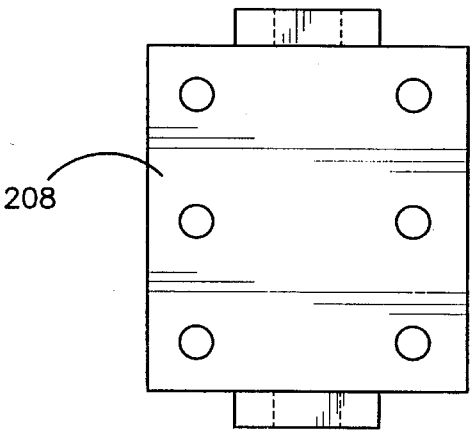
FIGS. 9D, 9E, 9F show side, front, and bottom views of the valve timing control rod guide bracket.
Figure 9D:
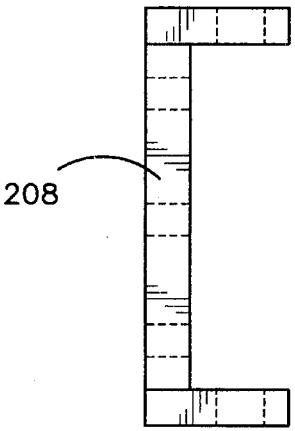
Figure 9F:
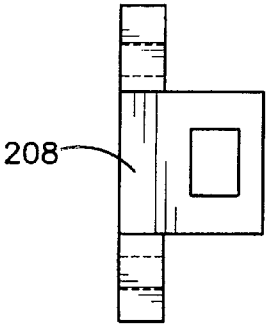
Figure 9B:
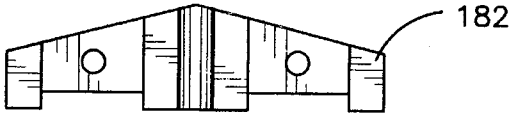
FIGS. 9B, 9C show top and front views of the rocker arm retaining pylon.
Figure 9C:
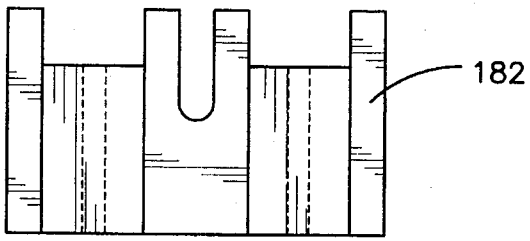

Sleeve 142 is equipped with two connecting tangs 168 which hold it both angularly and axially. FIG. 9A shows an end view of main shaft 22 with pod 134, and with cams 136 entering the three cylinder heads 170, 172, and 174. The three views show different phases of assembly of the mechanism for operating valves 176 (FIG. 9I). Head 170 shows cam 136 resting on the bottom halves of bearings 178 and 180. It also reveals with broken lines the position of cylinder 17 and valves 176 as well as their channels to the outside. Also shown in head 170 of FIG. 9A are pylons 182 which loosely hold valve rocker bars 184 in place as well as a cross-shaped member 186, also referred to herein as a fulcrum cross. Fulcrum bars 188, and rocker bar springs 190 are tightly bolted to pylons 182. The fulcrum crosses 186 have a control arm and a shorter cross arm.

The cylinder head of FIG. 9I shows the bars 184 and the cross 186 installed. The top halves of the cam shaft bearings 192 and 194 can be seen in cylinder heads 172 and 174 of FIG. 9A.

Head 174 of FIG. 9A shows the completed assembly of the valve operating mechanism with the installation of bars 188 and springs 190.

Cams 136 and crosses 186 are sealed at their points of exit from heads 170, 172, and 174 by rubber o-rings (not shown) inserted into grooves milled into the cylinder heads.

FIG. 9I reveals the location of rocker spring pin 196 through a hole in bar 188. It also shows the valve adjusting nut 198 and locknut 200 as well as the relative position of cam 136 and cross 186 to the other components. It is essential that when lobe 138 is not lifting rocker bar 184 there be a parallel relationship between the facing surfaces of rocker bar 184 and fulcrum bar 188. This is necessary so that sliding cross 186, back and forth within the cylinder head, will not affect the valve-lash adjustment. To aid in maintaining the parallel relationship, changeable shims 202 are installed under each end of fulcrum bars 188.

Figures 9G, 9H:
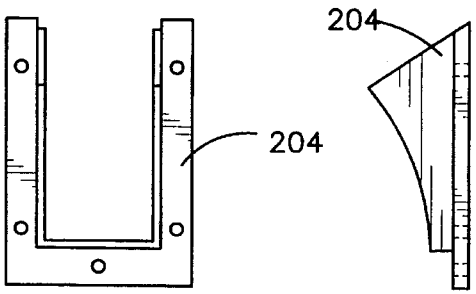
FIGS. 9G, 9H show side and bottom views of the bracket which stabilizes the sleeve of the reduction gear pod.
Figure 91:
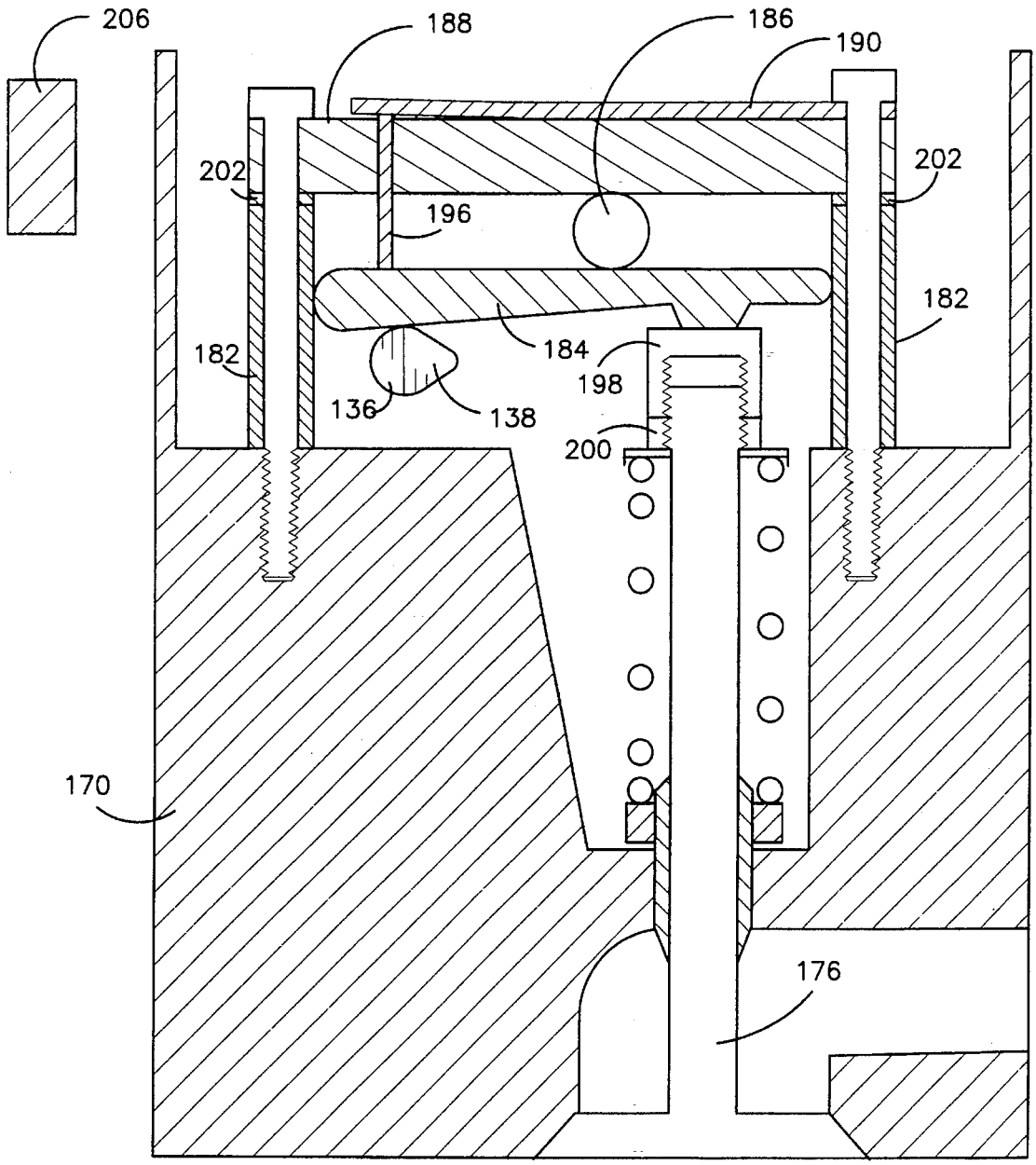

Head 174 of FIG. 9A shows a bracket 204 which houses tangs 168 of sleeve 142 and prevents axial movement of sleeve 142 along main shaft 22. FIGS. 9G, 9H show bracket 204 in more detail.

Also shown on head 174 of FIG. 9A is a bracket 206 which supports a mechanism (not shown in this view) for controlling the position of cross 186.

Mounted on head 170 of FIG. 9A is a bracket 208 (see also FIGS. 9D, 9E, 9F) which holds a square shaft 210 which has a hinge joint on one end and which is drilled and threaded from the other end. The hinge joint of shaft 210 is connected to the tangs 168 of sleeve 142 by a rod 212 that has holes drilled in each end perpendicular to its axis. Rod 212 is connected to shaft 210 and tangs 168 by two pins (not shown separately).

Screwed part way into shaft 210 is a compatibly threaded rod 214 which is equipped with two locking nuts 216 that limit the amount of travel of rod 214 into shaft 210. Rod 214 passes through a round hole in a bracket 218 mounted onto the top edge of head 170 (FIG. 9A). Fixed to rod 214 inside bracket 218 is a stabilizing collar 220 which acts on two thrust bearings 222.

Figure 10A:
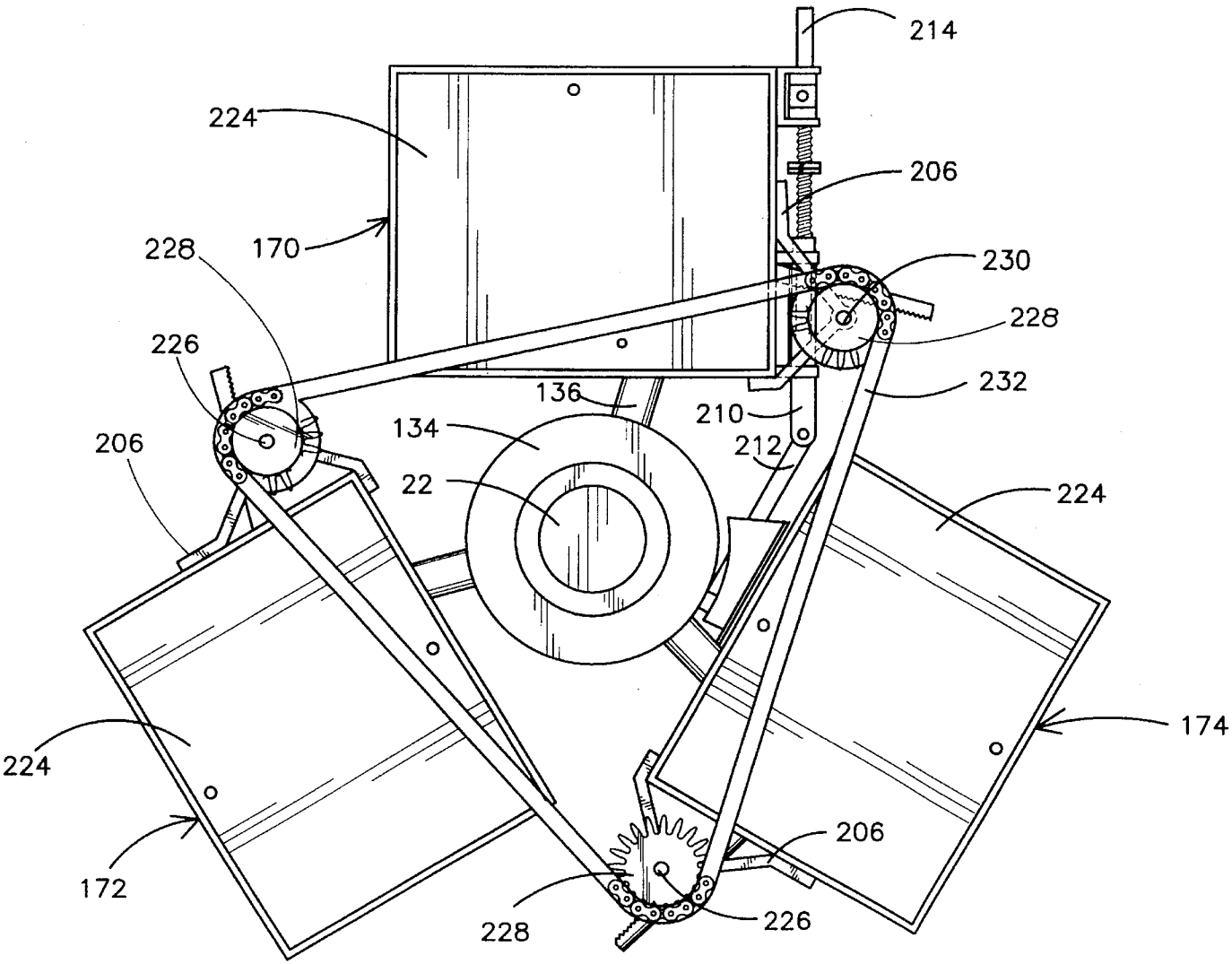
FIG. 10A shows a top view of the cylinder heads showing the valve lift control synchronizing mechanism.
Figure 10B:
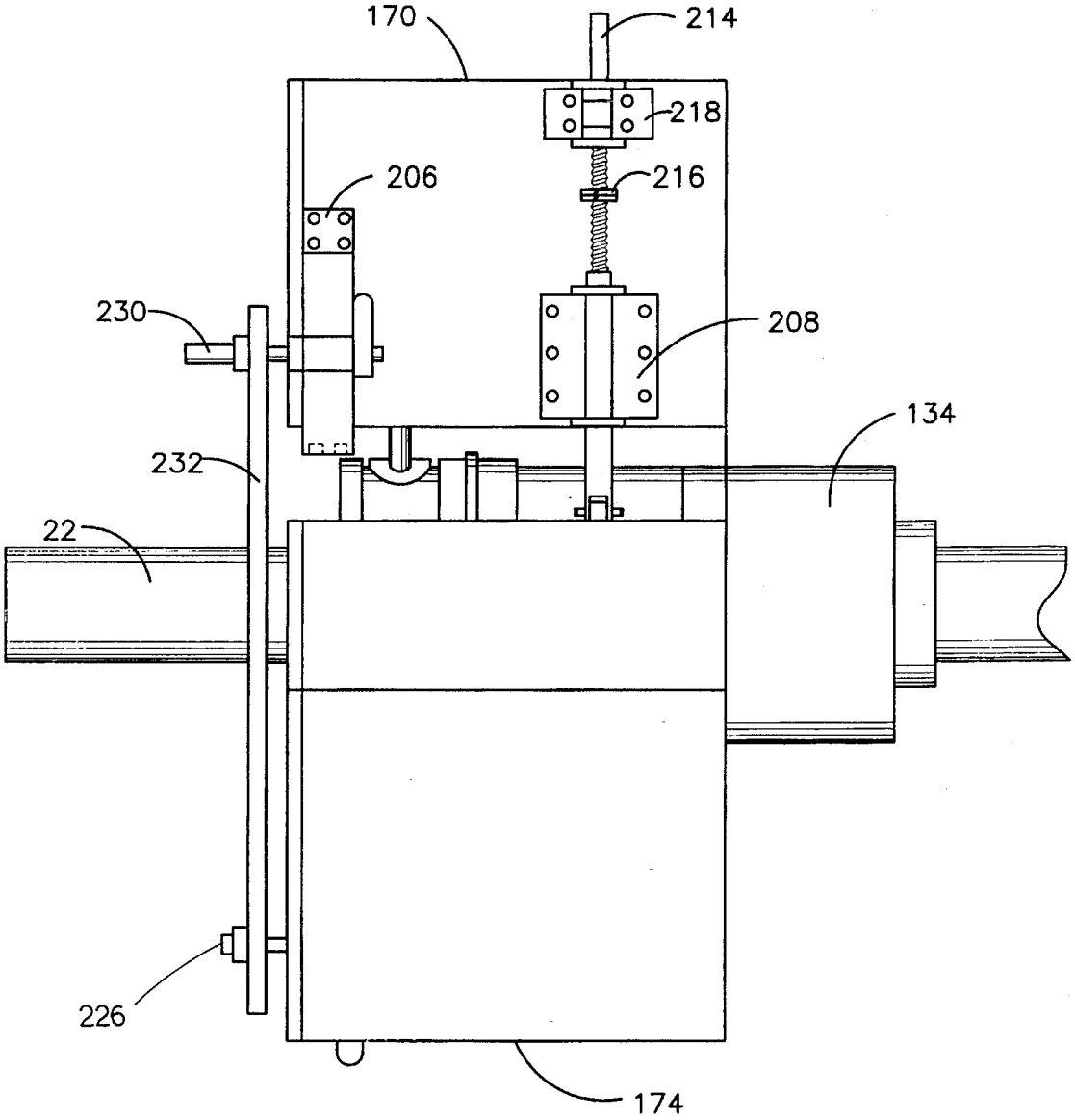
FIG. 10B shows a side view of the fully assembled cylinder heads.

FIGS. 10A and 10B reveal the cylinder heads with cover plates 224 installed as well as all three brackets 206. Each bracket 206 attached to the lower two heads 172 and 174 of FIG. 10A holds a torsion rod 226 to which is attached a chain sprocket 228 and a small pinion gear (not shown). Bracket 206 of the upper head 170 holds a torsion rod 230 which also has a sprocket 228 and pinion gear (not shown). Rod 230 is longer than rods 226 and it is used as the control input for the valve opening amplitude or valve lift.

The small pinion gears (not shown) mesh with the toothed section of the crosses 186 in conventional rack-and-pinion constructs. Sleeved bolts (not shown) are installed onto brackets 206 in such a fashion as to contact crosses 186 and hold them in mesh with the pinion gears.

A single chain 232 links all three sprockets 228 and ensures synchronized changes in the positions of the sprockets 228 and the crosses 186.

From FIG. 10B it can be seen that main shaft 22 extends past rod 230 where it is available to drive all the essential accessories which may include an electrical distributor, a fuel injector or injector pump, a cooling system, a generator or alternator, a turbocharger, and others.

Main shaft 22 is turned by a starter motor (not shown) acting on starter gear 42 so that hubs 68 through 74 as shown in FIG. 1 rotate away from the viewer or in a counterclockwise direction as viewed in FIG. 9A. Because hub 68 is connected to slew ring 50 by arms 76, slew ring 50 rotates with main shaft 22 as it spins freely on disc 48. With hubs 70, 72, and 74 in the positions shown in FIG. 1, revolution of main shaft 22 has no effect on disc 48 as it is held by slew ring 50 in a planar position that is perpendicular to main shaft 22. Therefore, there will be no movement or stroking of piston 62 resulting from the rotation of main shaft 22.

However, if rod 106 is turned in a clockwise direction (assuming right hand threading on bolts 94 and 96) hub 74 and hub 70 will be drawn in a direction away from plate 12. This will cause rod 80 to act on attachment structure 56 of slew ring 50 and to pull slew ring 50 out of its perpendicular relationship with main shaft 22. Referring to FIG. 1, this movement will also result in hub 68 and C.V. joint 46 being displaced to the right, but only by one half the distance of travel of hubs 70 and 74.

If main shaft 22 is rotated with the hubs in their new positions, that rotation will result in a nutating motion being imparted to disc 48 which will cause piston 62 to move back and forth in cylinder 17.

The degree of nutation experienced by disc 48 and consequently the piston stroke length is directly proportional to the difference in the distance between hubs 72 and 74 as shown in FIG. 1 and the distance between the same two hubs in any other configuration. If hub 74 is screwed all the way to its extreme position toward the flywheel and hub 72 is screwed to its extreme position in the opposite direction, rotation of main shaft 22 will result in the maximum piston stroke possible.

It will be appreciated that the closest distance that piston 62 achieves to the end of cylinder 17 on a full revolution of main shaft 22 can be regulated by controlling the position of hub 72 which is in turn controlled by rod 104. Consequently the angular position of rod 104 determines the compression ratio of the engine for any given stroke setting. From this it is seen that the compression ratio can be widely varied for any given piston stroke setting from a range that is compatible with diesel operation to one for gasoline use. Also by moving rod 104 in a compensatory fashion, a constant compression ratio can be maintained through a wide range of stroke settings.

FIG. 2 shows the result of rotating main shaft 22 through 180 degrees from its position in FIG. 1 and turning rod 106 to its extreme clockwise position. FIG. 2 also shows the angular shift of balancer 118 as it mirrors the angle of disc 48 to main shaft 22. This action compensates for any vibrational tendencies that might otherwise manifest from the rotational nutation of slew ring 50, the nutation of disc 48, and the reciprocating motion of the pistons.

It can be seen from FIG. 7C that this latter action is made possible by the indirect linkage between slew ring 50 and the balancer 118 through the mediation of rods 126 and 130, and slides 128. As slew ring 50 is drawn into a decreased angle to main shaft 22, it pushes on rods 130 which in turn push slides 128 along arms 76 in the direction of hub 68. This motion causes balancer 118 to be pulled into a correspondingly decreased angular orientation to main shaft 22.

Main shaft 22 passes through pod 134 where its teeth engage gears 140 and cause them to migrate around the inside of toothed sleeve 142 (which is held stationary by rod 212) while carrying pins 144. Consequently, gear 146 is made to turn by pins 144 which protrude into it. Because there are twice as many teeth cut into the inside of sleeve 142 as are cut into the toothed section of main shaft 22, the angular migration rate of gears 140 and therefore the revolution rate of gear 146, is one fourth the revolution rate of main shaft 22.

Cams 136 are turned by gears 148 which have only one half the number of teeth as does gear 146. As a result, cams 136 turn at twice the rate of gear 146 and one half the rate of main shaft 22. This condition is compatible with 4-cycle operation.

FIG. 9A reveals that the valve timing can be advanced by turning rod 214 in the direction which causes shaft 210 to be drawn upward and sleeve 142 to be rotated in a counterclockwise direction. This is because in this embodiment, main shaft 22 turns in a counterclockwise direction as viewed in FIG. 9A. Also it should be appreciated that the force of gears 140 on sleeve 142 is in a clockwise direction. That is why bracket 204 (FIGS. 9G, 9H) is designed as an enclosure instead of as two parallel guides. This design ensures that even if there is a failure in the linkage which holds sleeve 142 in angular position, tangs 168 will encounter the end plate of bracket 204 and be stopped. This is crucial because further rotation would be catastrophic as it would permit valve/piston collisions. The position at which tangs 168 encounter bracket 204 corresponds to the most retarded valve timing setting.

Since the valve timing can be advanced safely only within a small range (partially dependent on valve opening amplitude), it is important that the timing locknuts 216 be properly positioned on rod 214. Also other dynamic exclusionary interlocks may be put in place elsewhere.

FIG. 9I shows that the turning of cams 136 causes rockers 184 to be rotated about their contact points with crosses 186 as each lobe 138 pushes upward. The rotation of rockers 184 causes adjusting nuts 198 to be forced downward and to open valves 176. It is also apparent from FIG. 9E that the opening amplitude of valve 176 can be changed by moving the fulcrum cross 186 relative to the longitudinal axis of cam 136. Obviously if cross 186 is centered over adjusting nut 198 there will be no valve opening. Conversely, if cross 186 is moved as close as possible to pin 196, valve opening amplitude will be maximized.

The method of changing the position of crosses 186 relative to cams 136 can be seen by reference to FIGS. 10A and 10B. When control rod 230 is turned it causes all three sprockets 228 to turn synchronously and that causes the other torsion rods 226 to turn with control torsion rod 230.

The small pinion gears (not shown) fitted onto the ends of each torsion rod 226 and 230 drive the crosses 186 either inwardly or outwardly relative to cylinder heads 170, 172, and 174, and accordingly vary the valve opening amplitude.

Torsion rods 226 and 230 are used instead of more rigid alternatives to avoid moving crosses 186 while they are under load. The spring effect of the torsion rods allows crosses 186 to be moved during that portion of the valve cycle when they are free of pressure from cam lobes 138.

In summary the operation of this engine is similar to that of the conventional reciprocating engines in that pistons are made to move axially inside cylinders and in so doing, to first draw into the cylinder volume either a combustible mixture or air. They then compress that mixture or air in conjunction with properly timed valve action. Then either the combustible mixture is ignited by a timed electrical spark, or the air volume which is heated by near adiabatic conditions of the compression cycle, is injected with fuel which it ignites. The result in either case is the generation of a highly heated gaseous mass which applies force on the piston in the direction which is consistent with an increase in the volume of that mass. Subsequent piston movement results in the transformation of a substantial amount of the energy of the heated gaseous mass into a usable mechanical form.

Whereas in conventional engines the piston motion after the creation of the expansive gaseous mass is applied to the off-set journal of a rotating crankshaft, in this engine it is applied to a nutating component whose phase is linked to the rotational motion of a straight engine shaft. The force of the piston on the nutating component compels that component to alter its phase in a way that is in accord with the continued rotation of the main engine shaft. This is because the nutating component, being rotationally constrained, is denied the only other reactionary option which is to rotate in a direction opposite that of the main engine shaft.

The result is the harmonious application of energy from the firing cycles of each piston to the rotational output of the main engine shaft.

Since it is desirable for the firing cycles of the pistons to be spaced out evenly over the motion of two rotations of the main shaft in a 4-cycle engine, the number of equally spaced cylinders must be odd. This odd number allows a firing sequence that can be described as progressively-circularly-intermittent with no two consecutive cylinders firing on any given rotation of the main engine shaft.

Engine housing 18 is an assembly of an upper and lower section which meet along a horizontal planar line. This allows all stages of repair to be effected with the engine in its mounted position if surrounding space allows it. First the bolts connecting the two halves and those connecting the upper half to plate 12 are removed. Then by working through normally-plated access ports, one end of rod 82 is disconnected and then rod 104 is turned until control slew ring 86 clears bolts 90 and 92. Next both chains 116 are removed. Then positioning collars 112, sprockets 98, and gear 100 are loosened on the top three bolts (two bolts 94 and one bolt 96) of the stroke control mechanism. Then these three bolts are screwed out of slew 88. With the removal of a gearbox or other power input device the top half of housing 18 can then be removed exposing all components.

Further dismantling can be accomplished by loosening all power take-off gears and positioning collars on main shaft 22 and drawing main shaft 22 with flywheel 40 attached, out of the engine if surrounding space allows it. If not, flywheel 40 may have to be removed first and then main shaft 22.

The embodiment of this engine as shown in the drawings uses free ball bearings in races milled into disc 48 and slew ring 50 as well as in the control slew/disc pairings. This arrangement was chosen for its simplicity and the fact that it affords concentric stability between the slew rings and discs, as well as low friction thrust. However any thrust bearing system which provides concentric stability between the discs and slew rings will suffice. A list of such alternatives would include but would not be limited to the following:

The balls shown in the drawings but held in perforated circular brackets.

Loose ball bearings in races separate from the discs and slew rings but held in concentric position by steps or "shoulders" cut into each.

The second arrangement above, but with circular perforated brackets holding the individual ball bearings.

Loose tapered roller bearings in races cut into the discs and slew rings.

Roller bearings in their own separate races that fit onto the steps of the second arrangement above.

Cylindrical rollers with internal bearings mounted at the four main slew connecting points. The main slew ring need not be circular in this case.

The final decision of a manufacturer will take into account cost, repair and replaceability, durability, applicability to high speeds or high forces, etc.

This engine can be made to quickly change from gasoline to diesel operation and vice versa by rotating a carburetor out of or into the breathing system while leaving both diesel injectors and spark plugs in place. The requisite change in compression ratio can be accomplished instantly. The only other requirement is turning on or off a diesel injector pump. Admittedly a special form of non-fouling spark plug and possibly a special injector will be required.

The combination of a nutating and spinning slew ring and a non-spinning, nutating disc connected to reciprocating pistons, admittedly presents a complex balancing problem. If it is found through experimental tests, that a simple mirroring response of the balancer ring is not appropriate regardless of the amounts and locations of all weighting options, then the balancer can be made to react to an angle change in the slew ring in a non-linear way. It can be given any response curve desired by incorporating a cam plate with that curve inherent in its cut.

If a six cylindered engine is desired it can be assembled from two three cylinder engines placed on a single shaft in such a way as to mirror each other. Power can be taken from either end or from the center. This arrangement will result in relative cost savings as it will obviate the need for balancers as the symmetric motions of the two engines will tend to annul each other. Such an assembly can share a common housing, and with a gearbox centrally mounted, it can assume an overall T-configuration.

The piston rod connections to the disc 48 can be mounted onto the side of disc 48 nearest plate 12. The piston rod connections can either project perpendicularly to disc 48 or they can offset slew ring 50 and effectively extend the diameter and accessibility of disc 48 by reentering the plane of disc 48 at a radius greater than that of the slew ring 50 or they can establish a new plane parallel to that of disc 48. In the former case the cylinders 17 can be shifted from their axially parallel relationship to main shaft 22, to any angle up to and including a perpendicular or radial relationship with main shaft 22.

In the latter case the cylinders can be oriented at any angle relative to the main shaft including a reflexive position in which the cylinders are again parallel to the main shaft but are 180 degrees from their positions in the preferred embodiment.

This latter geometry when combined with the "T" configuration described above, may be the most practical for automotive applications despite a slight mechanical disadvantage in its nutating physics. This is because it can be made into a self-balancing, compact unit with a number of cylinders, namely six, that is compatible with automotive use.

In this case the central common housing will have bulges on each end which will house the disc extensions and receive the cylinder ends. The two support plates will approximately define the width in this case. Some control functions of the two engines can be merged.

A variation of this theme can be made by in effect mounting two engines on the same shaft with their support-plate ends almost together with just enough space between them to afford a channel for the power take-off train. Obviously any such design which modifies the piston position from those in the preferred embodiment must make corresponding modifications in the geometry of the valve operating mechanism.

The nutating disc 48 as depicted in the preferred embodiment is basically solid except for connecting holes and cutouts for the piston connecting rods. However, a manufactured disc would likely have other strategically-located cutouts to lessen weight and the "fanning" effect of nutational motion without sacrificing a significant percentage of strength.

Elasticity can be easily incorporated into this engine by replacing rod 82 with one of spring steel which has a slight curve. Also two flat spring steel pieces with concavities facing outward could be used to replace rod 82. The common space between them (on their convex sides) can be equipped with a linearly-corrugated "flat" spring.

On applications which do not require special piston head geometry, the two perpendicular wrist pins at the piston ends of rods 64 (or at both ends) can be replaced with ball joints if desired.

By carefully choosing the ratio of the radial distance of the attachment structure on slew ring 50, to the radial distance to the point of connection of the piston connecting rods, an engine can be designed so that only minimal movement is required of rod 104 to maintain a constant compression ratio over a wide range of piston stroke settings.

The crossed wrist pins on the ends of rods 64 can be replaced with conventional U-joints. This is more easily done on the disc end but it can be done on both ends if desired.

Control sprockets 98 on the five shorter control bolts 90 and 94 of each set of control bolts can be replaced by ones which are identical dimensionally but which have a slight flexibility built into them between a toothed ring and a rigid core. This flexibility will preclude any problem that might otherwise arise from slight differences in angular position between different bolts of the same set. Such differences could possibly result from a worn chain or thrust bearing. Any such significant difference could possibly cause a control mechanism to bind up. Obviously the sprockets on the top control bolts 92 and 96 would retain the rigid design.

Because of the elimination of exposure to the circular motion of conventional crankshaft engines, the connecting rods of this engine do not have to endure significant lateral forces or high-speed, one directional spinning. Consequently, there is no need for a "big end". Also wear on the piston connecting rods and lateral forces on the pistons are much less than for conventional crankshaft engines.

It has been an object of the design of the subject engine to keep all control inputs independent of each other in order to afford the greatest degree of flexibility. However, if an engineer can tolerate the partial coupling of the valve timing control and the timing of a distributor for a particular embodiment, he or she can take the power to drive the distributor from a valve cam 136. This can easily be effected by drilling through the side of a cylinder head in line with the axis of cam 136 and on centrally through the assembly of bearing halves 180 and 194 and on into the end of cam 136. A rod of smaller diameter than cam 136 can be keyed into the end of cam 136 and used to drive the electrical distributor.

Starting this engine can be done on low or medium stroke setting. This will require less torque than on a full stroke setting and it will extend the useful life of a starter motor, the ring gear, and a battery.

The use of this engine obviates the need for a widely-variable transmission in some applications because of the wide range of torque and revolution rate output that is possible.

If the control slews 86 and 88 experience a significant degree of angular displacement, they can easily be stabilized by cutting a slot in each of their outer edges in a direction parallel to main shaft 22. A rigid bar with mounting connections to housing 18 can be fitted into these slots in such a way as to permit the slews 86 and 88 to travel axially along main shaft 22 but not to rotate about it. Such rotation if allowed would skew the hexagonal sets of control bolts 90, 92, 94, and 96 and possibly cause a halting response to control action.

Ported two-cycle engines of this basic design can only be constructed for systems using a fixed or only slightly variable piston stroke length with only the compression ratio significantly variable. However, two-cycle valved engines can be designed with widely-variable compression ratio and piston stroke length.

In applications which do not require very short piston strokes, it is likely that the valve opening variability feature can be eliminated with attendant cost savings.

If an engine is needed for application to a work load that is unchanging or changes very little, all the variability features of the preferred embodiment can be eliminated. This will yield a model similar to a conventional crankshaft engine, but it will be lighter and more compact. Such an engine will need only one hub with at least three connections to a slew ring. It can still be made so that adjustments in compression ratio and stroke length are possible on the stopped engine. Such an engine can also be made to switch between operation on diesel fuel and operation on gasoline.

For small utility type engines it is possible to replace the C.V. joint 46 with a radial array of spring steel slats. This is specially workable if the diameter of the nutating disc is great enough to effect the maximum stroke length without undergoing a large angular shift.

It is to be understood that the present invention is not limited to the sole embodiment described above, but encompasses any and all embodiments within the scope of the following claims.

I claim:

1. An engine comprising:

a housing having a longitudinal axis, a first end, and a second end;

a main shaft rotatably supported by said housing, said main shaft having a longitudinal axis coincident with the longitudinal axis of said housing;

a plurality of cylinders supported by said housing, said plurality of cylinders being radially disposed about said shaft;

a plurality of pistons corresponding in number to said plurality of cylinders, each of said plurality of pistons disposed within a respective one of said plurality of cylinders, each of said plurality of pistons reciprocating within said respective one of said plurality of cylinders;

a nutating member having a central opening, said main shaft passing through said central opening, said nutating member being in nutational motion in response to said plurality of pistons reciprocating within respective ones of said plurality of cylinders;

means for rotationally constraining said nutating member, said means for rotationally constraining said nutating member substantially preventing forces, generated in reaction to torque output from said engine, from being borne by said plurality of cylinders, said means for rotationally constraining said nutating member being a constant velocity joint disposed within said central opening, said constant velocity joint including, an inner ball portion having external splines, said external splines forming grooves therebetween, an outer socket portion having internal splines, said internal splines forming grooves therebetween, a plurality of ball bearings, each of said plurality of ball bearings engaging a respective groove on said inner ball portion and a respective groove in said outer socket portion to thereby prevent relative rotation between said inner ball portion and said outer socket portion, and a cage located intermediate said inner ball portion and said outer socket portion, whereby said cage retains said plurality of ball bearings within said constant velocity joint; and means for converting the nutational motion of said nutating member into rotational motion of said main shaft.

2. The engine according to claim 1, wherein said nutating member is a nutating disc having an outer rim.

3. The engine according to claim 2, wherein said means for converting the nutational motion of said nutating member include:

a slew ring rotationally engaging the outer rim of said nutating disc, said slew ring having first and second attachment structures;

a first hub slidably mounted on said main shaft, said first hub having splines which matingly engage splines on said main shaft, whereby said first hub rotates with said main shaft;

a second hub slidably mounted on said main shaft, said second hub having splines which matingly engage splines on said main shaft, whereby said second hub rotates with said main shaft;

a first control rod extending between said first hub and said first attachment structure; and a second control rod extending between said second hub and said second attachment structure, whereby movement of said first hub and said second hub along said main shaft controls the position and the orientation of said nutating disc.

4. The engine according to claim 1, further including:

a plurality of piston rods corresponding in number to said plurality of pistons, each of said plurality of piston rods having first and second ends, said first end of each of said plurality of piston rods being connected to a respective one of said plurality of pistons.

5. The engine according to claim 1, further including:

a balancer ring; and means for moving said balancer ring, said means for moving said balancer ring being responsive to changes in the angle of nutation of said nutating member.

6. The engine according to claim 1, further including:

a plurality of planetary gears matingly engaging a toothed portion on said main shaft;

a ring gear surrounding said plurality of planetary gears, said ring gear matingly engaging said plurality of planetary gears, whereby said plurality of planetary gears are capable of migrating within an annular space between said main shaft and said ring gear;

a bevel gear provided on said main shaft, said bevel gear being freely rotatable with respect to said main shaft; and a plurality of pins corresponding in number to said plurality of planetary gears, each of said plurality of pins being centrally housed within a respective one of said plurality of planetary gears, each of said plurality of pins having a protruding portion which protrudes from said respective one of said plurality of planetary gears, said protruding portions of said plurality of pins engaging recesses provided in said bevel gear, whereby migration of said plurality of planetary gears within said annular space causes rotation of said bevel gear.

7. The engine according to claim 6, further including:

a plurality of cylinder heads corresponding in number to said plurality of cylinders, said plurality of cylinder heads acting as closures for respective ones of said plurality of cylinders, and said plurality of cylinder heads being provided with intake and exhaust valves, each of said intake and exhaust valves having an opening time, a closing time, and a lift; and a plurality of cam shafts actuating said intake and exhaust valves, said plurality of cam shafts controlling the opening time and the closing time of said intake and exhaust valves, and said plurality of cam shafts being driven by said bevel gear, whereby shifting of said ring gear about the longitudinal axis of said main shaft varies the opening time and the closing time of said intake and exhaust valves.

8. The engine according to claim 7, wherein said plurality of cam shafts actuate said intake and exhaust valves via rocker arms, and each of said rocker arms has a pivot point.

9. The engine according to claim 8, further including:

a plurality of cross-shaped members, each of said plurality of cross-shaped members having a control arm and a cross arm, said cross arm defining the pivot point for said rocker arms, whereby the lift of said intake and exhaust valves is varied by axial movement of said control arms of said plurality of cross-shaped members.

10. An engine comprising:

a housing having a longitudinal axis, a first end, and a second end;

a main shaft rotatably supported by said housing, said main shaft having a longitudinal axis coincident with the longitudinal axis of said housing;

a plurality of cylinders supported by said housing, said plurality of cylinders being radially disposed about said shaft;

a plurality of pistons corresponding in number to said plurality of cylinders, each of said plurality of pistons disposed within a respective one of said plurality of cylinders, each of said plurality of pistons reciprocating within said respective one of said plurality of cylinders;

a plurality of piston rods corresponding in number to said plurality of pistons, each of said plurality of piston rods having first and second ends, said first end of each of said plurality of piston rods being connected to a respective one of said plurality of pistons;

a nutating member having a central opening, said main shaft passing through said central opening, said nutating member being provided with couplings engaging a respective one of said plurality of piston rods at its second end, said nutating member being in nutational motion in response to said plurality of pistons reciprocating within respective ones of said plurality of cylinders;

means for converting the nutational motion of said nutating member into rotational motion of said main shaft;

a plurality of planetary gears matingly engaging a toothed portion on said main shaft;

a ring gear surrounding said plurality of planetary gears, said ring gear matingly engaging said plurality of planetary gears, whereby said plurality of planetary gears are capable of migrating within an annular space between said main shaft and said ring gear;

a bevel gear provided on said main shaft, said bevel gear being freely rotatable with respect to said main shaft; and a plurality of pins corresponding in number to said plurality of planetary gears, each of said plurality of pins being centrally housed within a respective one of said plurality of planetary gears, each of said plurality of pins having a protruding portion which protrudes from said respective one of said plurality of planetary gears, said protruding portions of said plurality of pins engaging recesses provided in said bevel gear, whereby migration of said plurality planetary gears within said annular space causes rotation of said bevel gear.

11. The engine according to claim 10, wherein said nutating member is a nutating disc having an outer rim.

12. The engine according to claim 11, wherein said means for converting the nutational motion of said nutating member include:

a slew ring rotationally engaging the outer rim of said nutating disc, said slew ring having first and second attachment structures;

a first hub slidably mounted on said main shaft, said first hub having splines which matingly engage splines on said main shaft, whereby said first hub rotates with said main shaft;

a second hub slidably mounted on said main shaft, said second hub having splines which matingly engage splines on said main shaft, whereby said second hub rotates with said main shaft;

a first control rod extending between said first hub and said first attachment structure; and a second control rod extending between said second hub and said second attachment structure, whereby movement of said first hub and said second hub along said main shaft controls the position and the orientation of said nutating disc.

13. The engine according to claim 10, further including:

a balancer ring; and means for moving said balancer ring, said means for moving said balancer ring being responsive to changes in the angle of nutation of said nutating member.

14. The engine according to claim 10, further including:

a plurality of cylinder heads corresponding in number to said plurality of cylinders, said plurality of cylinder heads acting as closures for respective ones of said plurality of cylinders, and said plurality of cylinder heads being provided with intake and exhaust valves, each of said intake and exhaust valves having an opening time, a closing time, and a lift; and a plurality of cam shafts actuating said intake and exhaust valves, said plurality of cam shafts controlling the opening time and the closing time of said intake and exhaust valves, and said plurality of cam shafts being driven by said bevel gear, whereby shifting of said ring gear about the longitudinal axis of said main shaft varies the opening time and the closing time of said intake and exhaust valves.

15. The engine according to claim 14, wherein said plurality of cam shafts actuate said intake and exhaust valves via rocker arms, and each of said rocker arms has a pivot point.

16. The engine according to claim 15, further including:

a plurality of cross-shaped members, each of said plurality of cross-shaped members having a control arm and a cross arm, said cross arm defining the pivot point for said rocker arms, whereby the lift of said intake and exhaust valves is varied by axial movement of said control arms of said plurality of cross-shaped members.

17. The engine according to claim 10, wherein forces existing between said means for converting the nutational motion of said nutating member and said nutating member acting at substantially the same radial distance from said longitudinal axis of said main shaft as forces transmitted by said plurality of piston rods.

18. An engine comprising:

a housing having a longitudinal axis, a first end, and a second end;

a main shaft rotatably supported by said housing, said main shaft having a longitudinal axis coincident with the longitudinal axis of said housing;

at least one cylinder supported by said housing;

at least one piston disposed within said at least one cylinder, said at least one piston reciprocating within said at least one cylinder;

a nutating member having a central opening, said main shaft passing through said central opening, said nutating member being in nutational motion in response to said at least one piston reciprocating within said at least one cylinder;

means for rotationally constraining said nutating member, said means for rotationally constraining said nutating member substantially preventing forces, generated in reaction to torque output from said engine, from being borne by said at least one cylinder, said means for rotationally constraining said nutating member being a constant velocity joint disposed within said central opening, said constant velocity joint including, an inner ball portion having external splines, said external splines forming grooves therebetween, an outer socket portion having internal splines, said internal splines forming grooves therebetween, a plurality of ball bearing, each of said plurality of ball bearings engaging a respective groove on said inner ball portion and a respective groove in said outer socket portion to thereby prevent relative rotation between said inner ball portion and said outer socket portion, and a cage located intermediate said inner ball portion and said outer socket portion, whereby said cage retains said plurality of ball bearings within said constant velocity joint; and means for converting the nutational motion of said nutating member into rotational motion of said main shaft.

* * * * *